US011406569B2

(12) United States Patent
Hornthal et al.

(10) Patent No.: US 11,406,569 B2
(45) Date of Patent: Aug. 9, 2022

(54) PACIFIER DEVICES

(71) Applicants: David Adam Hornthal, Deerfield, IL (US); Erica Joy Hornthal, Deerfield, IL (US)

(72) Inventors: David Adam Hornthal, Deerfield, IL (US); Erica Joy Hornthal, Deerfield, IL (US)

( * ) Notice: Subject to any disclaimer, the term of this patent is extended or adjusted under 35 U.S.C. 154(b) by 0 days.

(21) Appl. No.: 17/387,515

(22) Filed: Jul. 28, 2021

(65) Prior Publication Data

US 2022/0087905 A1 Mar. 24, 2022

Related U.S. Application Data

(63) Continuation-in-part of application No. 17/028,677, filed on Sep. 22, 2020, now Pat. No. 11,103,424.

(51) Int. Cl.
*A61J 17/00* (2006.01)

(52) U.S. Cl.
CPC ..... *A61J 17/113* (2020.05); *A61J 17/001* (2015.05); *A61J 17/105* (2020.05); *A61J 17/111* (2020.05)

(58) Field of Classification Search
CPC ..... A61J 17/001; A61J 17/111; A61J 17/1115; A61J 17/02; A61J 17/10; A61J 17/105; A61J 17/113; A63H 3/003
USPC ..... 24/307, 312, 321, 580.1
See application file for complete search history.

(56) References Cited

U.S. PATENT DOCUMENTS

| | | | | |
|---|---|---|---|---|
| 3,900,927 | A * | 8/1975 | D'Angelo | A44C 5/2057 24/667 |
| 4,697,589 | A | 10/1987 | King | |
| 2002/0187719 | A1* | 12/2002 | Schneider | A63H 3/02 446/72 |
| 2008/0215092 | A1* | 9/2008 | Smith | A61J 17/001 606/236 |
| 2010/0155440 | A1* | 6/2010 | Hoyt | A61J 17/02 224/250 |
| 2010/0234887 | A1 | 9/2010 | Smith | |
| 2016/0199264 | A1 | 7/2016 | McClintock | |
| 2016/0236103 | A1 | 8/2016 | Pettrey, III | |
| 2016/0325193 | A1 | 11/2016 | Stewart | |
| 2019/0175454 | A1 | 6/2019 | Pierce | |

* cited by examiner

*Primary Examiner* — Diane D Yabut
*Assistant Examiner* — Christina C Lauer
(74) *Attorney, Agent, or Firm* — Nixon Peabody LLP

(57) ABSTRACT

Implementations of the present disclosure describe a pacifier device having a base portion, a nipple portion, and an attachment portion. The nipple portion is coupled to and protruding from the base portion in a first direction. The attachment portion is coupled to and protruding from the base portion in a second direction that is generally opposite to the first direction. The attachment portion is configured to rotate with the pacifier device to aid in connecting the pacifier device to a hub. The attachment portion may be inserted into a slot on an outer surface of a body to form a pacifier system.

19 Claims, 25 Drawing Sheets

PACIFIER DEVICES

TECHNICAL FIELD

This disclosure relates to pacifier devices and more specifically to pacifier devices with multiple suckers.

BACKGROUND

Parents and care givers use pacifiers to help soothe babies for many reasons. Often, babies spit out the pacifier and/or lose the pacifier unintentionally, which can cause the baby to become upset. In some instances, babies hold a portion of the pacifier, but cannot readily locate the sucker portion that they want to suck or chew.

Pacifiers have been coupled to plush toys which can stimulate and engage infants. However, the attached toy can be distracting and even frustrating to the child, parent or guardian. Where the device, such as a plush toy with one sucker, can be placed on an infant, the placement of the toy can determine if the sucker is well positioned to be accepted by the infant's mouth. Attachment of the sucker to the plush toy is also typically by a single tab, where if the toy falls on the wrong side, the sucker can end up face down. Therefore, the sucker can end up poorly oriented with respect to the infant, or far from the infant, who may try to suck or chew on whatever portion of the plush animal or sucker is closest to their mouth. Conventional suckers are also not symmetric from top to bottom and, when in use, ventilation holes, that are located in a top portion, are close to the infant's nose to facilitate breathing. If the plush animal is upside down, the ventilation holes are not properly disposed and can cause discomfort leading to the child spitting out the pacifier and or crying. The plush toy in general is also easy to tip over, or has low symmetry, and this can exacerbate the frustrations already noted. These issues may require the parent or guardian to repeatedly intervene and re-orient the plush animal so the pacifier is directed into the infant's mouth.

There is therefore a need for pacifier and pacifier devices that are easy for a child to locate and use. The present disclosure is directed to this need and addressing other problems.

SUMMARY

According to some implementations of the present disclosure, a pacifier device includes a body. A first arm and a second arm extend from the body. A first sucker is coupled to a distal end portion of the first arm, and a second sucker is coupled to a distal end portion of the second arm. Optionally, the pacifier device further includes a third arm extending from the body, and a third sucker coupled to a distal end portion of the third arm.

According to some implementations of the present disclosure, a pacifier system includes a body and a pacifier device. The body has an outer surface with a slot therein that extends into the body. The pacifier device includes a nipple portion and an attachment portion. The nipple portion extends in a first direction and the attachment portion extends in a second direction. The attachment portion is configured to be inserted into the slot of the body to aid in connecting the pacifier device with the body.

According to some implementations of the present disclosure, a pacifier device having a sucker and an adapter. The sucker has a base portion and a nipple portion protruding therefrom. The adapter includes a compartment and a compartment portion coupled thereto. The attachment portion is configured to aid in connecting the pacifier device with a hub. The compartment portion is configured to accommodate at least a portion of the sucker therein.

According to some implementations of the present disclosure, a pacifier device includes a base portion, a nipple portion, and an attachment portion. The nipple portion is coupled to and protruding from the base portion in a first direction. The attachment portion is coupled to and protruding from the base portion in a second direction that is generally opposite to the first direction. The attachment portion is configured to rotate with the pacifier device to aid in connecting the pacifier device to a hub.

The above summary is not intended to represent each implementation or every aspect of the present disclosure. Additional features and benefits of the present disclosure are apparent from the detailed description and figures set forth below.

BRIEF DESCRIPTION OF THE DRAWINGS

The foregoing and other advantages of the present disclosure will become apparent upon reading the following detailed description and upon reference to the drawings.

Figure 1:
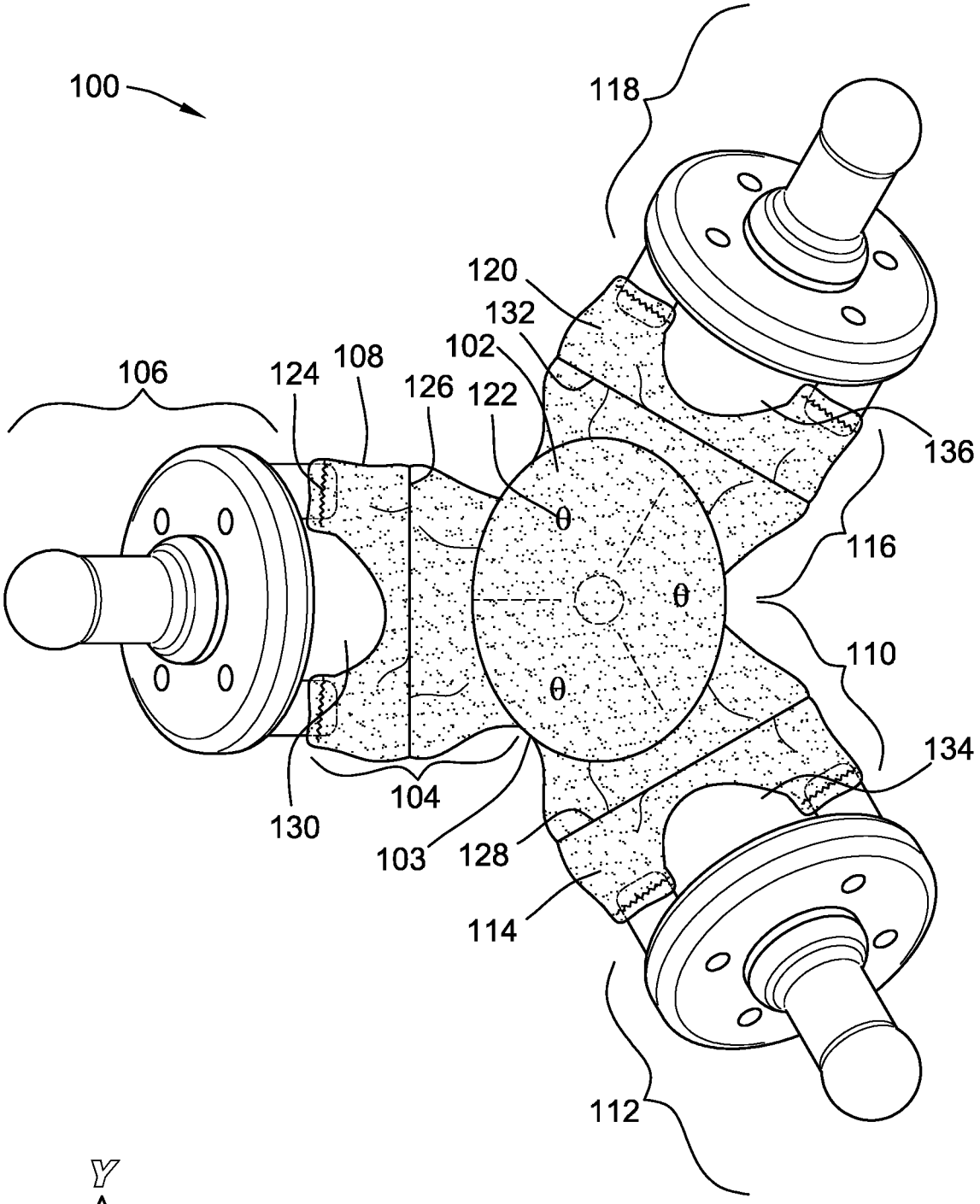
FIG. 1 shows a perspective view of a pacifier device 100, according to some implementations of the present disclosure.
Figure 1:
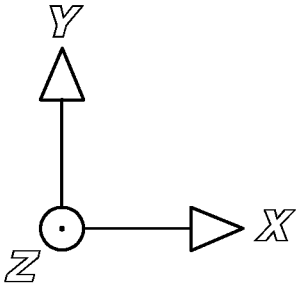

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the present disclosure as defined by the appended claims.

DETAILED DESCRIPTION

The present disclosure is directed to a pacifier device that has multiple (e.g., two, three, four, etc.) suckers attached to a plush body. The pacifier device has multiple legs/arms and/or attachment points that are spaced from one another to space the suckers about the pacifier device.

Referring generally to FIG. 1 a pacifier device 100 is shown. A first arm 104, and a second arm 110 extend from a body 102. A first sucker 106 is coupled to a distal portion of the first arm 108, and a second sucker 112 is coupled to a distal portion of the second arm 114.

According to some implementations, the pacifier devices can include two, three, four or more arms with suckers attached thereto. For example, a third arm 116 is shown extending from the body 102 of pacifier device 100. A third sucker 118 is couple to a distal end portion of the third arm 120. Other implementations can include a fourth arm extending from the body 102, and a fourth sucker coupled to a distal end portion of the fourth arm.

The body 102 can be any shape. In some other implementations, the central body is a geometric shape, for example circular (as shown), square, doughnut, rectangular, star shaped, triangular shape etc. In some implementations, the central body is in the shape of a mythical or real animal, such as such as a unicorn or an octopus. In some in some implementations, the central body is in the shape of a plant, such as a flower. In some implementations, the central body is an irregular shape.

In some implementations, the body 102 is generally flat, wherein the average dimensions of width/height or circumference (XY directions shown in FIG. 1) is greater than the average depth (Z direction, up and out of the page). In part due to the generally flat configuration of the body 102, the body 102 tends to lie flat on a general level surface, and can be flipped over to also lie flatly on an opposite side. Accordingly, the body 102 can lie on a child's body on either of the flat sides of the body 102, with two or more suckers 106, 112 generally pointing upwards.

The arms can be bi-furcated, such as in the distal portion of the first arm 108. The bi-furcation defines a notch 130 in first arm 104. Similar bifurcation defines a notch 134 in second arm 110 and a notch 136 in third arm 116.

The arms 104, 110 and 116 can be any useful length but are generally proportioned to not extend beyond a child's belly when the pacifier device 100 is placed on the child. In some implementation the arms extend from the center of the body 102 between about 1.5" and 6". In some implementations, each of the first arm 104, the second arm 110 and the third arm 116 are of about equal length.

The arms can be attached at any position around the body 102, such as at any radial position along a periphery 103 of the central body. In some implementations, the arms are regularly spaced around the body. For example, arms 104, 110, 116 project radially from the body 102 and are spaced at regular angles 122 of θ=120 degrees. In implementations having two arms, the arms can be about 180 degrees, or opposite to each other. In implementations having four arms, the arms can be about 90 degrees.

In some implementations, the suckers are fixed to the distal ends of the arm to which they are coupled. As used herein "fixed" refers to a permanent coupling. The suckers can be fixed to their corresponding arm by any method. For example, the suckers can be fixed to the corresponding arm using one or more of an adhesive, a tread, a rivet, a melt weld etc. In some implementations, the first sucker 106 is fixed to the distal end portion of the first arm 108 using one or more stitches 124. In some implementations, the stitches are hidden inside an arm, such as the distal end portion of the first arm 108.

According to some other implementations, the suckers are removably coupled to the distal ends of the arm to which they are coupled. For example, the coupling can be provided by hook and loop fasteners, snaps, clips, toggles, zippers, or any combinations thereof. In some implementations, the first sucker 106 is removably coupled to the distal end portion of the first arm 108 via a first fastener, the second sucker 112 is removably coupled to the distal end portion of the second arm 114 via a second fastener, and the third sucker 118 is removably coupled to the distal end portion of the third arm 120 via a third fastener. This removable coupling feature allows the suckers, such as suckers 106, 112, and 118, to be removed from the rest of the body of the pacifier device 100 and for cleaning or replacement. For example, where the sucker can be clean and sterilized such as by immersion in boiling water.

Figure 2A:
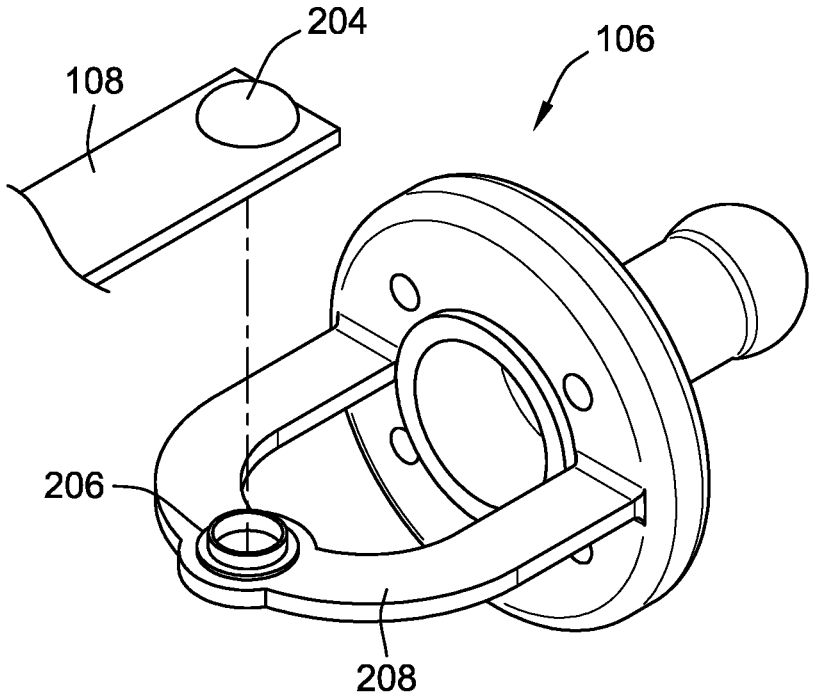
FIG. 2A shows a perspective view of a sucker and a first optional removable coupling feature, according to some implementations of the present disclosure.

FIG. 2A shows a perspective view of an embodiment of a snap for a pacifier device such as device 100. The first snap portion 204 is located on the distal end of an arm, such as first arm 108. The second snap portion 206 is located on an attachment portion 208 of a sucker, such as the first sucker 106. The first snap portion 204 couples to the second snap portion 206, thereby removably coupling the sucker 106 to the first arm 104. In some implementations, more than one snaps are used.

Figure 2B:
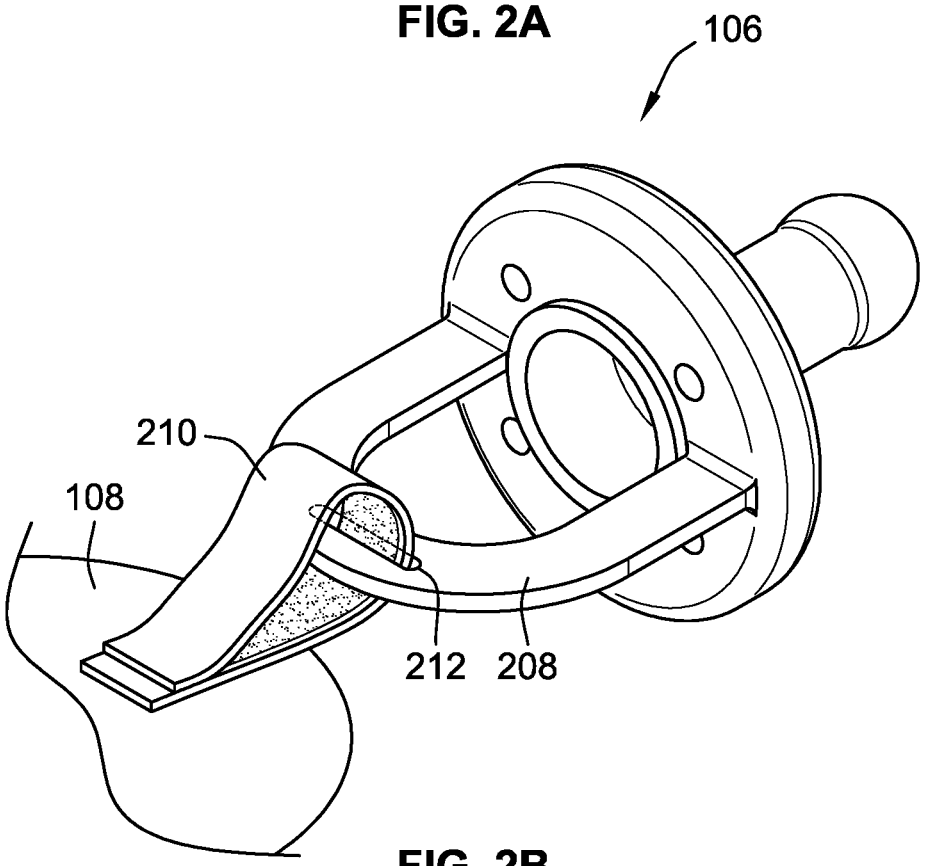
FIG. 2B shows a perspective view of a sucker and a second optional removable coupling feature, according to some implementations of the present disclosure.

FIG. 2B shows a perspective view of the first sucker 106 including a hook and loop fastener 210. A hook and loop containing strip 210 is located on the distal end of the first arm 108. The hook and loop fastener 210 is inserted into a mating slot 212 positioned in the attachment portion 208 of the first sucker 106. Bending the hook and loop fastener 210 on itself removably couples the first sucker 106 to the distal end of first arm 108. Other implementations are possible include using two or more hook and loop fasteners. Another possible implantation includes a hook or loop portion located on the distal end of first arm 108, and the other of the hook or loop portion located on the attachment portion 208 of the first sucker 106.

Another feature according to some implementations includes a hinge, such as a first hinge portion 126 that is shown in FIG. 1. The first hinge portion 126 is formed in the first arm 104 adjacent to the first sucker 106 to aid the first sucker 106 in moving relative to the body 102. A second hinge portion 128 is formed in the second arm 110 adjacent to the second sucker 112 to aid the second sucker 112 in moving relative to the body 102. Similarly, in options where a third sucker is used, a third hinge portion 132 is formed in the third arm 116 to aid the third sucker 118 in moving relative to body 102.

The hinge 126 can be formed by any method. For example, by heat sealing, application of an adhesive, ultrasonic welding, or stitching. In some implementations the first hinge portion 126 includes a first stitched line formed across a width of the first arm 104 and the second hinge portion 128 includes a second stitched line formed across a width of the second arm 110. In options where a third sucker is used, a third hinge portion 132 includes a third stitch line formed across a width of the third arm 116. In some implementations, the distal portion of the first arm 108 and the rest of the first arm 104 form two distinct elements that are connected by a hinge. For example, the hinge can be formed by loops of soft plastic or thread, or a flexible material such as a cloth or plastic.

As noted, the hinge 126 aids in allowing movement of the sucker relative to the body 102. Where the body 102 is flat and the entire pacifier device 100 can be flipped over to lie on either flat side, the suckers 106, 112, 118 can adjust to point upward in part facilitated by the respective hinges 126, 128 and 132. Where the device 100 is placed on a baby, this feature provides easy access to one of the two or more suckers. In addition, if the device 100 falls a floor or ground, the suckers are less likely to directly contact the floor or ground and thereby remain clean.

In some implementations, the body 102, and the arms, such as the first arm 104, the second arm 110, and the third arm 116 are formed by one or more sheets of material sewn together and stuffed with a plush material.

The sheets of material can be made of any material, such as hypoallergenic and flame resistant materials. For example, sheets of material can be made of any synthetic or natural materials including wool, cotton, nylon, spandex, polyester, leather, plastic, rubber, mixed compositions of these materials, and combinations of these. For example, fleeces made with one or more of these materials can be used to provide a plush exterior feel. The sheet materials can include a faux fur exterior, or can be more generally smooth. In some implementations, the sheet materials can include portions, patterns or sections having higher friction such as a soft plastic or silicon rubber features (e.g., disks, strips). These can aid in keeping the pacifier device 100 on a baby's stomach rather than slipping off. These can also provide a tactile stimulus and grip for the baby, for example when these higher friction features are included on the arms 104, 110 and 116.

The plush materials for stuffing can be any soft material such as soft hypoallergenic and flame resistant materials. Some examples include synthetic or natural materials including felt, wool, cotton, nylon, polyester, fleece, plastic, rubber, down and feathers, cellulosic materials (e.g., straw, wood wool, kapok), mixed blends of these materials, and combinations of these. For example, cotton, polyester foams and memory foams can be used.

In some implementations, the pacifier device 100, as well as serving to sooth an infant by way of the first sucker 106, also can be colorful, have features to make noise, or have appendages to provide visual, audible and/or tactile to the infant. For example, the arms, such as first arm 104 can be dimensioned to be easy to grip by an infant. As well as providing tactile stimulation, this feature can help the child build hand strength/coordination and aids in helping the child orient a sucker to their mouth. Accordingly, the materials making the first arm 104, the sheets and stuffing, are chosen and designed to compress to accommodate the size of an infant's grip. For example, the compressed diameter of the first arm 104, or a portion of the first arm 104, should be between about 0.1 and about 2". In addition, appendages, such as grips and nubs, can be added to the arms for easy gripping.

In some implementations materials or elements are included in the pacifier device 100 to make noises. For example, in some implementations a crinkle material is included in the sheets or stuffing used to make the arms or body of the pacifier device 100. Without limitation, the crinkly material can be selected from synthetic materials such as rayon and polyamide. As another example, a rattle or other noise making device can be added to the pacifier device, such as being sewn into the interior of the body 102 or an arm, such as first arm 104.

The pacifier device 100 can also include one or more weights, for example positioned within the body 102, the first arm 104, the second arm 110, the third arm 116, or any combination thereof. For example, the weights can include beads or beans made of plastic, rubber, metal, silicone, relatively dense plush material, or any combination thereof. The weights, such as bead, can be localized in pouches and optionally sewn into the sheets or material of the pacifier device 100. In some implementations, the one or more weights are only positioned within the body 102 and not in the first arm 104, the second arm 110, or the third arm 116. The one or more weights aid in maintaining a position of the pacifier device when in use on a chest of a baby.

In some implementations, the pacifier device includes a wire frame positioned at least partially within the body 102, the first arm 104, the second arm 110, and the third arm 116. The wire frame includes a metal wire coated with a second material. The second material including plastic, silicone, fabric, or any combination thereof. The wire frame aids in adjusting relative positions of the first arm, the second arm, and the third arm. In some implementations, the frame is excluded from the distal portions of the arms, such as the distal portion of the first arm 108 so that the hinge 126 is free to operate, allowing the first sucker 106 to freely swivel up and down.

Figure 3A:
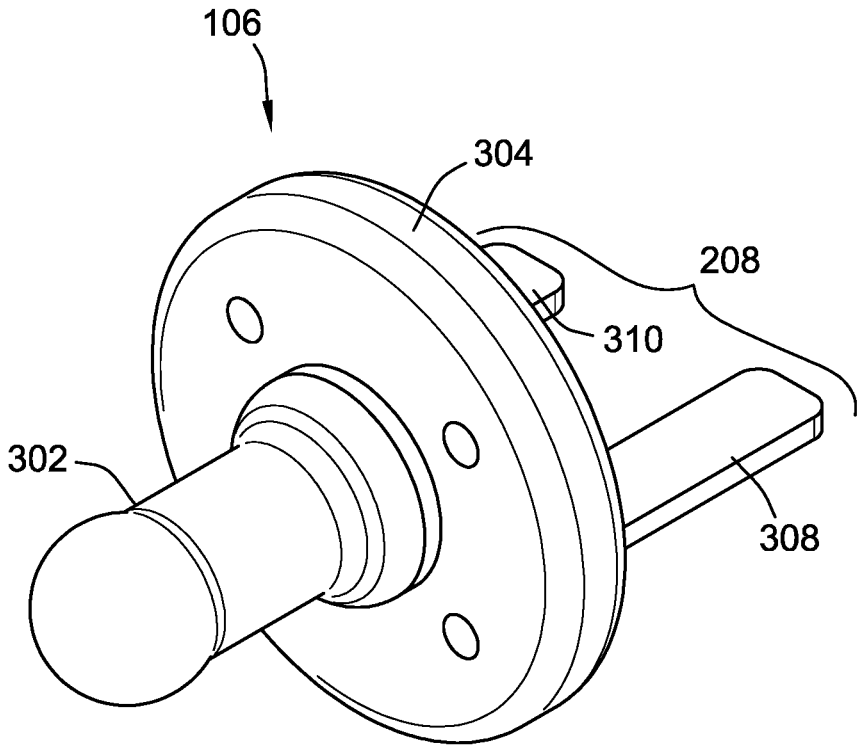
FIG. 3A shows a front perspective view of a sucker, according to some implementations of the present disclosure.
Figure 3B:
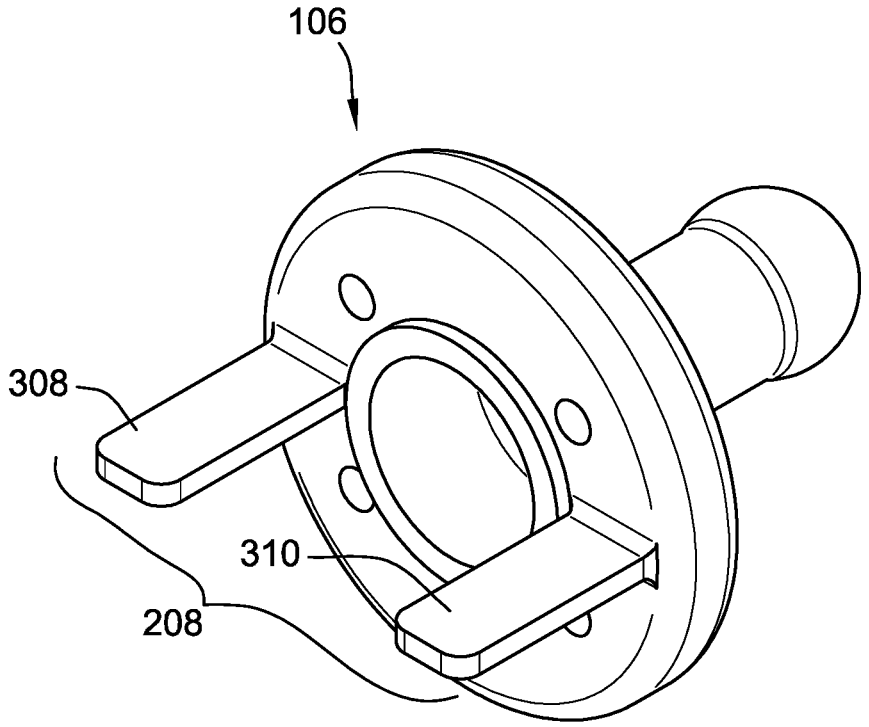
FIG. 3B shows a back perspective view of the sucker of FIG. 3A, according to some implementations of the present disclosure.

Turning now to FIGS. 3A and 3B, some details of an implementation of the first sucker 106 is shown. FIG. 3A is a front perspective view and FIG. 3B is a back perspective view. Both figures show the first sucker 106 including a nipple portion 302, a base portion 304, and the attachment portion 208. The base portion 304, at least in part, serves the purpose of a guard to prevent the first sucker 106 being swallowed. The nipple portion 302 is coupled to the base portion 304 and extends in a first direction therefrom. The attachment portion 208 is coupled to the base portion 304 and extends in a second opposing direction therefrom. In some implementations two or more of the nipple portion 302, the base portion 304 and the attachment portion 208 are a single unit, such as a molded unit. In some implementations, the nipple portion 302, and optionally the base portion 304 and attachment portion 208, are made of silicone, rubber, natural rubber or latex.

The attachment portion 208 can include two tab 308, 310. In some implementations, the two tabs 308 and 310 are connected. For example, the two tabs 308 and 310 may form a single attachment portion 208 as shown by the u-shaped attachment portion 208 in FIGS. 2A and 2B.

Figure 4A:
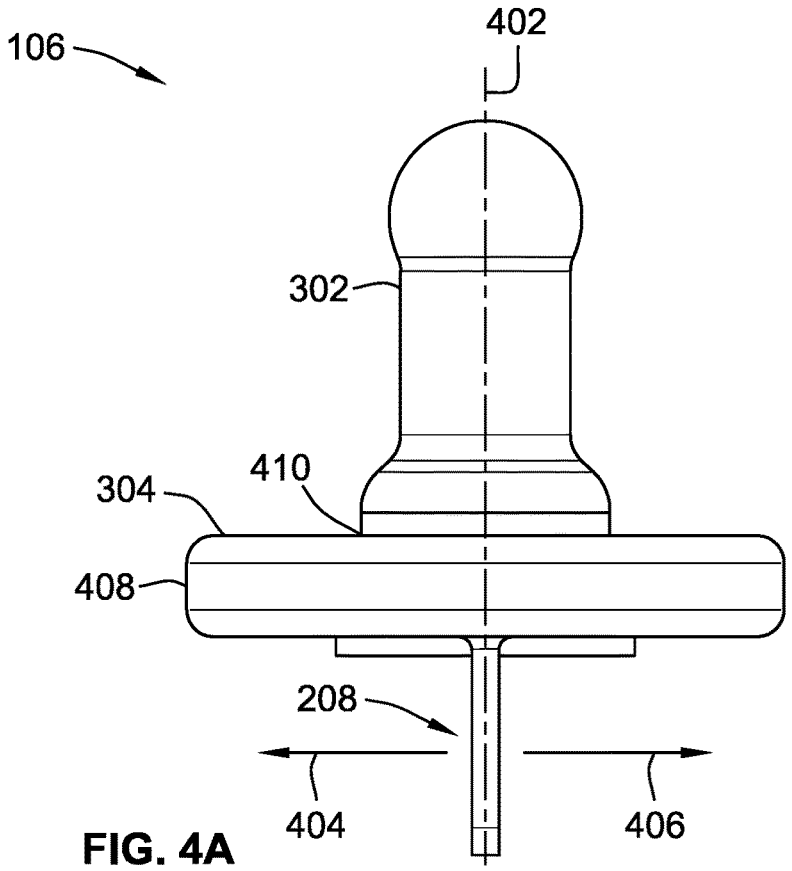
FIG. 4A shows a side view of the sucker of FIG. 3A, according to some implementations of the present disclosure.
Figure 4B:
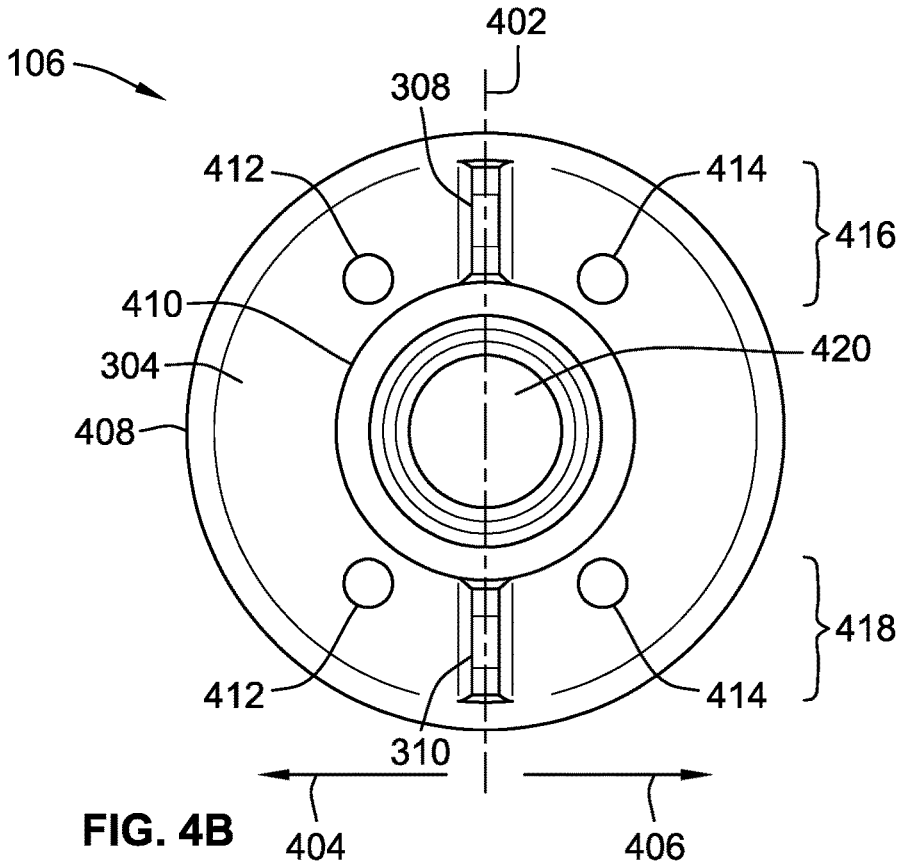
FIG. 4B shows a back view of the sucker of FIG. 3A, according to some implementations of the present disclosure.

FIGS. 4A and 4B show some other views of the first sucker 106 illustrated in FIGS. 3A and 3B. FIG. 4A is a side view of the first sucker 106, and FIG. 4B is a back view of the first sucker 106. These views also show the nipple portion 302, the base portion 304, and the attachment portion 208 or the tabs 308 and 310 of the attachment portion 208.

As shown by FIGS. 4A and 4B, the attachment portion 208 is coupled to the base portion 304 along a mirror plane 402 of the first sucker 106. The first sucker includes a first half, indicated by arrow 404, on a first side of the mirror plane, and a second half, indicated by arrow 406, on a second side of the mirror plane. The base portion 304 has an outer perimeter 408, and inner perimeter 410. In some implementations, the outer perimeter 408 and the inner perimeter 410 are independently generally circular in shape. Other shapes are contemplated for either of outer perimeter 408 or inner perimeter 410. For example, the shape can be more elliptical in shape or even rectangular, such as rectangular with rounded edges. In some implementations the shape includes flattened portions or facets.

The base portion 304 defines a first pair of breathing apertures 412 therein and a second pair of breathing apertures 414 therein. The first pair of breathing apertures 412 are located in the first half 404 of the sucker between the outer perimeter 408 and inner perimeter 410. The second pair of breathing apertures 414 are located in the second half 406 of the sucker between the outer perimeter 408 and inner perimeter 410. The breathing apertures 412 and 414 provide ventilation while the sucker is being used by a baby.

As previously described, the attachment portion 208 can include a first tab 308 and a second tab 310. The first tab 308 of the attachment portion 208 is located adjacent to a first side portion 416 of the base portion 304 that is between the inner and outer perimeters 408, 410. The second tab 310 of the attachment portion 208 is located adjacent to an opposing second side portion 418 of the base portion 304 that is between inner and outer perimeters 408, 410.

Figure 5:
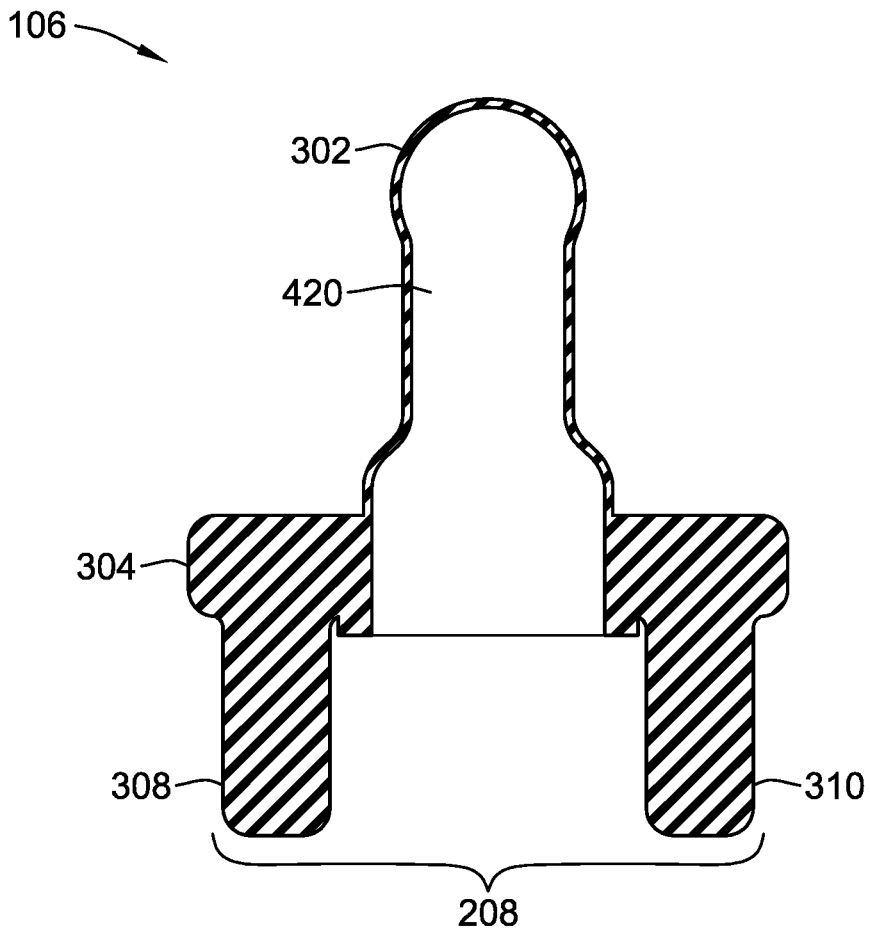
FIG. 5 shows a side cross-sectional view of the sucker of FIG. 3A, according to some implementations of the present disclosure.

FIG. 5 shows a cross cut side view of the first sucker 106. The cross cut view is along the mirror plane 402 defined previously (FIG. 4A, 4B). The nipple portion 302 and the base portion 304 of the first sucker 106 define a finger cavity 420. The figure cavity is configured to receive at least a portion of a finger therein. Access to the finger cavity 420 is generally defined as being between the first tab 308 and second tab 310 of the attachment portion. Access to the figure cavity 420 is further defined as being generally defined between the first pair of breathing apertures 412 and second pairs of breathing apertures 414 (FIG. 4A, 4B). Notches, such as notch 130, (FIG. 1) at the distal end portion of the first arm 104 also aid in providing access to the finger cavity. The finger cavity aids in allowing a parent or guardian to direct a pacifier, such as a first sucker 106, into an infant's mouth.

Figure 6:
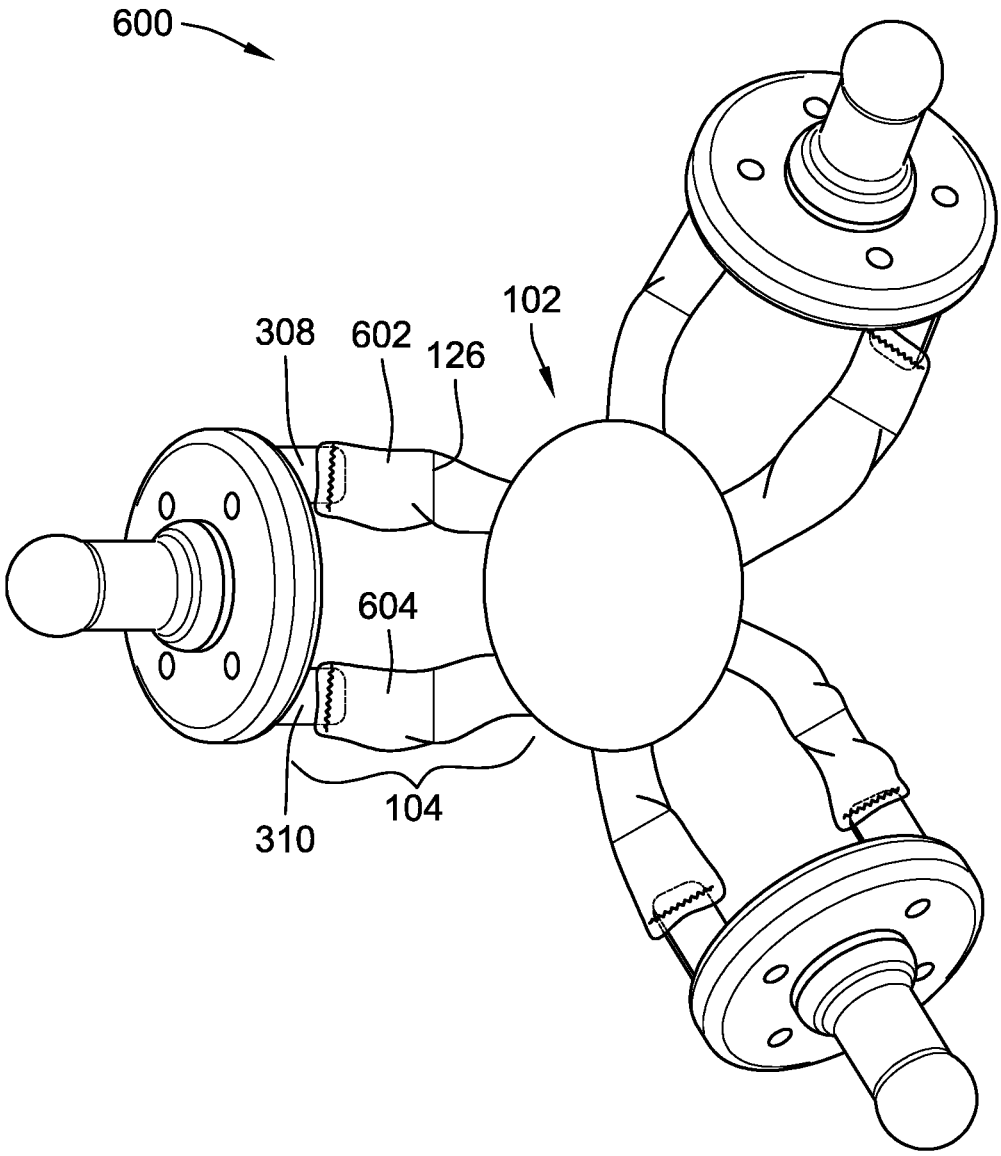
FIG. 6 shows a perspective view of a pacifier device 600, according to some implementations of the present disclosure.
Figure 6:
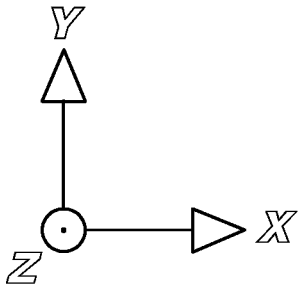

FIG. 6 shows an alternative pacifier device 600 according to some implementations. Pacifier device 600 is similar to pacifier device 100 but include an extreme bi-furcation of the arms attached to the body 102. Each of the arms connecting the body 102 to one of the pacifiers, such as first arm 104, includes a first branch 602 and a second branch 604. The first branch 602 is connected to the first tab 308, and the second branch 604 is connected to the second tab 310. Other features are appropriately modified. For example, the hinge 126, is included on both the first branch 602 and the second branch 604.

Figure 7A:
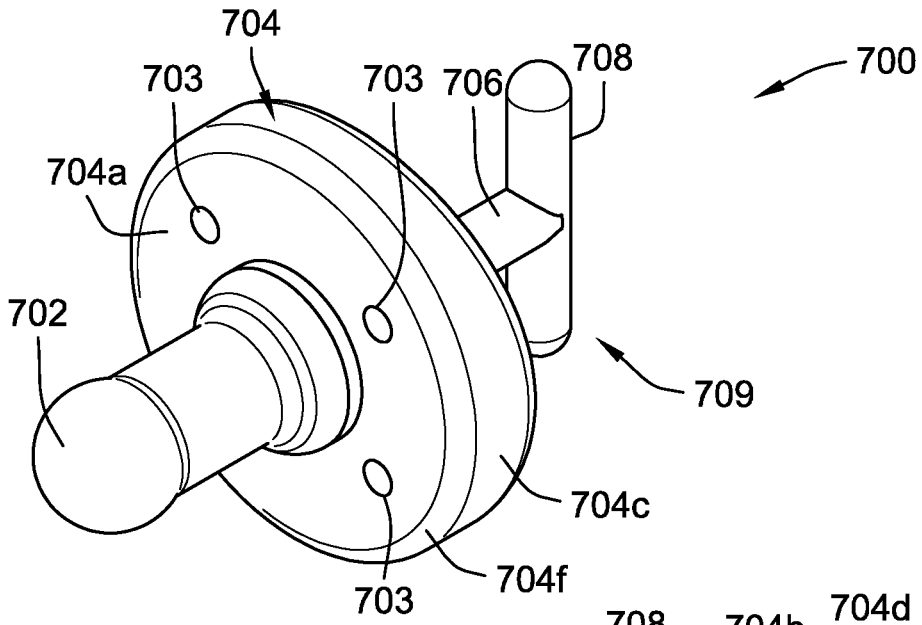
FIGS. 7A-7C show front perspective, rear perspective, and cross-sectional perspective views respectively, of a pacifier device having a rotatable attachment portion and two strips of hook-and-loop fasteners on a rear surface of the attachment portion, according to some implementations of the present disclosure.
Figure 7B:
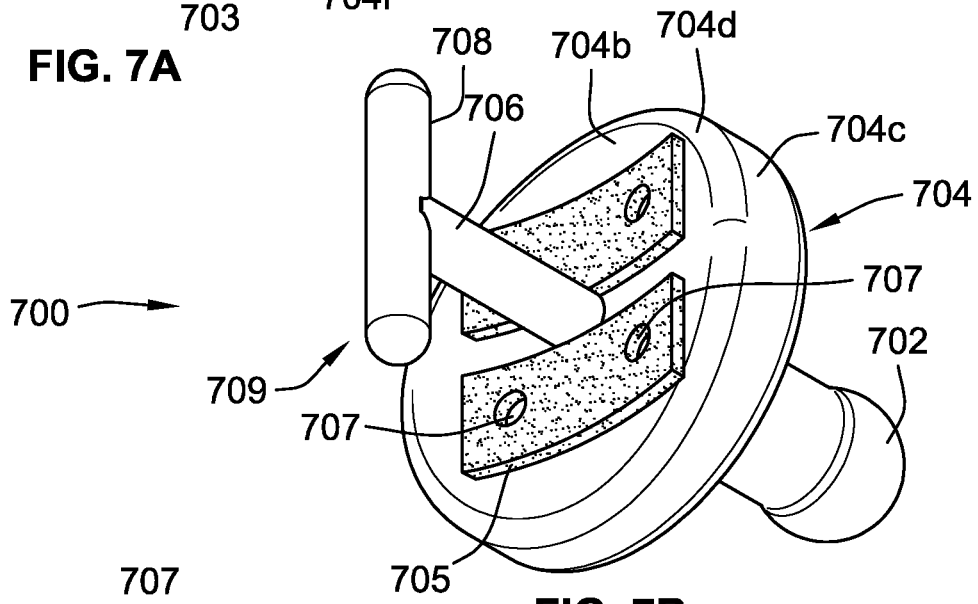
Figure 7C:
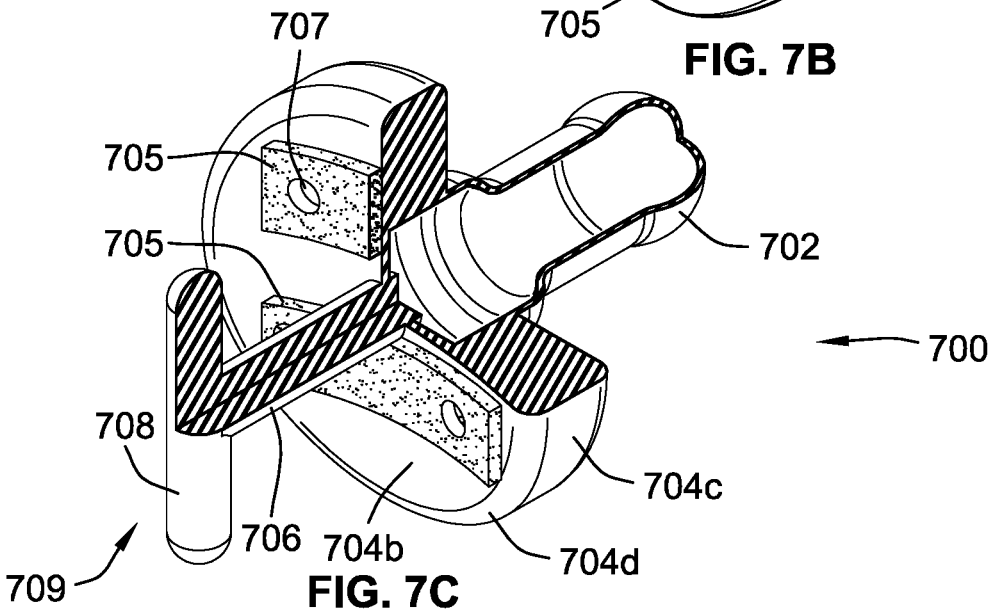
Figure 8A:
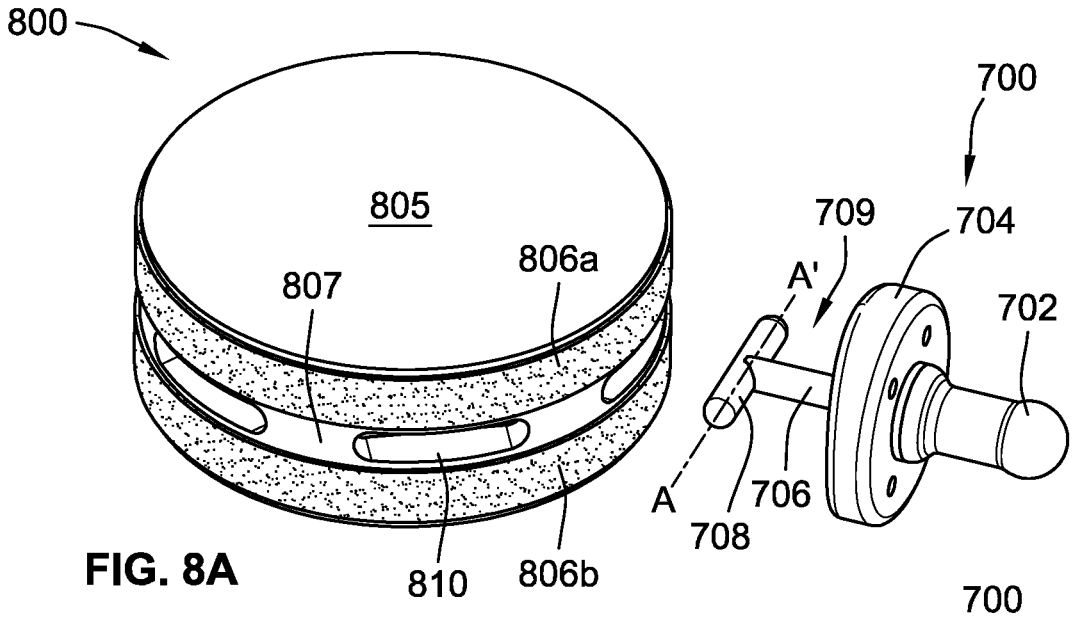
FIGS. 8A-8D show perspective views of four different stages of how the pacifier device of FIGS. 7A-7C fits into a slot on an outer surface of a body in a pacifier system, according to some implementations of the present disclosure.
Figure 9A:
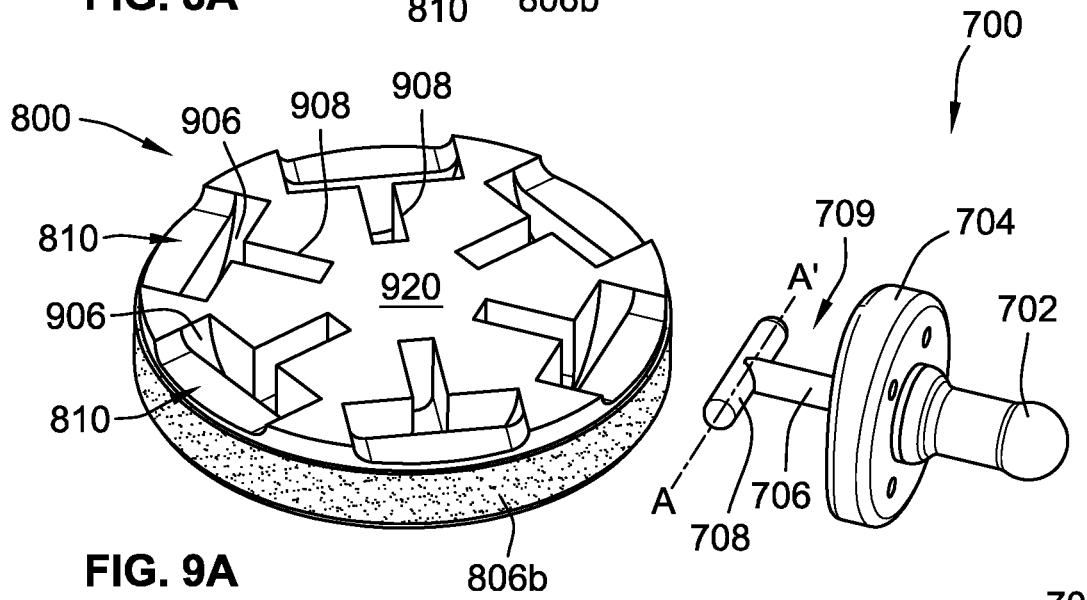
FIGS. 9A-9D show halved top perspective views of the four different stages of FIGS. 8A-8D, according to some implementations of the present disclosure.

FIGS. 7A-7C show front perspective, rear perspective, and cross-sectional perspective views respectively, of a pacifier device 700. The pacifier device 700 has a nipple portion 702, a base portion 704, and an attachment portion 709. In some implementations, the pacifier device 700 including the nipple portion 702, the base portion 704, and the attachment portion 709 form an integrated unit made of a single material such as, but not limited to, plastic, rubber, silicone, etc.

The base portion 704 includes a front surface 704*a*, a rear surface 704*b*, and an outer surface 704*c* between the front surface 704*a* and the rear surface 704*b*. In some implementations such as shown in FIGS. 7A-7C, the base portion 704 has a chamfered front edge 704*f* and a chamfered rear edge 704*d*. The base portion 704 includes breathing apertures 703 through and between the front surface 704*a* and the rear surface 704*b*. The breathing apertures 703 are substantially similar to the breathing apertures 412, 414 described above and provide ventilation while the pacifier device 700 is being used by a baby.

In some implementations such as shown in FIGS. 7A-7C, a coupling mechanism including one or more strips 705 of hook-and-loop fasteners such as, but not limited to, Velcro® (FIGS. 7A-7C show two strips of Velcro®) may be disposed on the rear surface 704*b* of the base portion 704. The one or more strips 705 of hook-and-loop fasteners include holes 707 aligned with the breathing apertures 703 such that ventilation through the latter remains unhindered. The holes 707 may be as many or more in number compared to the breathing apertures 703. In the implementations such as shown in FIGS. 7A-7C, each of the two strips 705 of hook-and-loop fasteners includes two holes 707 aligned with the corresponding breathing apertures 703. In other implementations, a different coupling mechanism may be disposed on or adjacent to the rear surface 704*b* of the base portion 704 and configured to couple the pacifier device 700 to a suitable location for use by a baby.

The nipple portion 702 is coupled to the base portion 704 and extends in a first direction from the front surface 704*a* of the base portion 704. The nipple portion 702 and the base portion 704 are substantially similar to those of the first sucker 106 described with respect to FIG. 1-5 above, except that the pacifier device 700 has the attachment portion 709, which is formed by one or more linking members. In some implementations such as shown in FIGS. 7A-7C, the attachment portion 709 extends in a second direction from the rear surface 704*b* of the base portion 704 opposing that of the nipple portion 702. In other implementations, the attachment portion 709 may extend from the base portion 704 at an angle with respect to the nipple portion 702, such as from a side of the base portion 704.

In some implementations such as shown in FIGS. 7A-7C, the attachment portion 709 generally has a T-shape formed by a first linking member 706 attached to the rear surface 704*b* of the base portion 704 and a second linking member 708 perpendicular to the first linking member 706. In other implementations, the attachment portion 709 may have a C-shape, Z-shape, L-shape, S-shape, X-shape, V-shape, Y-shape, and the like. The attachment portion 709 is configured to be inserted into a slot positioned for using the pacifier device 700. As discussed below, the attachment portion 709 can only be inserted into the slot when in a first orientation but not when in a second orientation.

FIGS. 8A-8D, FIGS. 9A-9D, and FIGS. 10A-10D, when viewed in conjunction, fully illustrate four different stages of attaching the pacifier device 700 to a body 805 to form a pacifier system 800. In some implementations, the body 805 may be referred to as a hub (including a body), a central hub, a base station, and the like. FIGS. 8A-8D show perspective views of the pacifier system 800, while FIGS. 9A-9D show corresponding halved top perspective views and FIGS. 10A-10D show corresponding cross-sectional views along a horizontal plane. While in the implementations shown in FIGS. 8A-8D, the body 805 is generally cylindrical in shape, it is contemplated that the body 805 may have any three-dimensional shape such as, but not limited to, a cuboid, a cone, a sphere, and the like. The body 805 has a first portion 806*a* and a second portion 806*b* opposing the first portion 806*a*. The body 805 has an outer surface 807, at least a portion of which is covered with hook-and-loop fasteners (e.g. two strips 1007 of Velcro® shown in FIGS. 10A-10D) and is thus configured to attach with the one or more strips 705 of hook-and-loop fasteners disposed on the rear surface 704*b* of the pacifier device 700. In some implementations, the entire outer surface 807 may be covered with hook-and-loop fasteners.

The body 805 has one or more slots 810 disposed on the outer surface 807 between the first portion 806*a* and the second portion 806*b*. In some implementations, the body 805 has a plurality of slots 810 on the outer surface 807. For example, in the implementation shown in FIGS. 9A-9D, the body 805 has six slots 810 around a central cavity 920, though in other implementations, there may be more or less than six slots. Each slot 810 is configured to accommodate and lock into position the pacifier device 700. As shown in FIGS. 9A-9D, each slot 910 opens into a first chamber 906 and a second chamber 908 positioned interior of the first chamber 906 adjacent to the central cavity 920. The first chamber 906 is configured to receive the attachment portion 709 of the pacifier device 700 only when the attachment portion 709 is in a first orientation (e.g., the longitudinal axis A-A' of the linking member 708 being parallel to the horizontal plane), but not when the attachment portion 709 is in a second orientation (e.g., the longitudinal axis A-A' of the linking member 708 being perpendicular to the horizontal plane). The second chamber 908 is configured to lock the attachment portion 709 to the body 805.

Figure 10A:
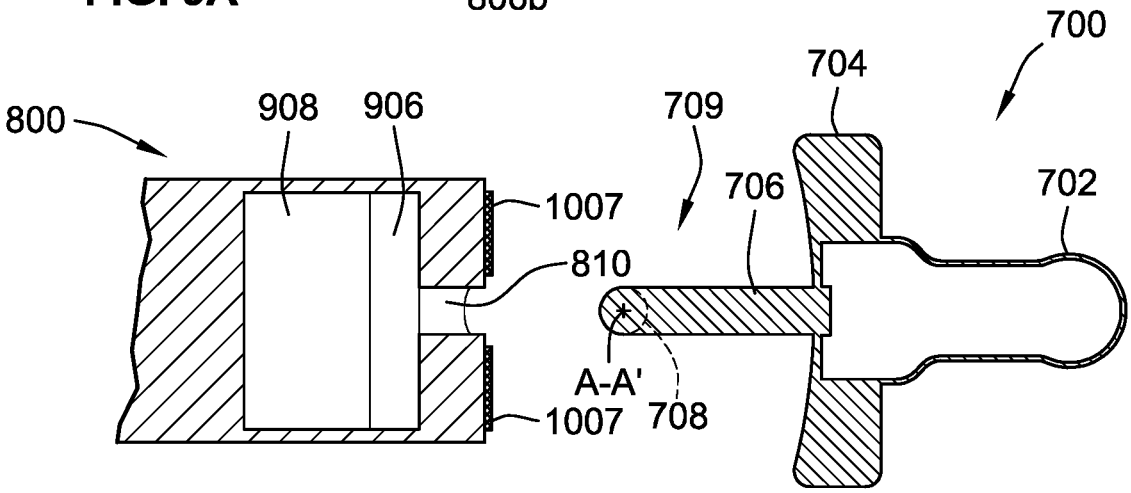
FIGS. 10A-10D show cross-sectional views along a horizontal plane of the four different stages of FIGS. 8A-8D, according to some implementations of the present disclosure.
Figure 8B:
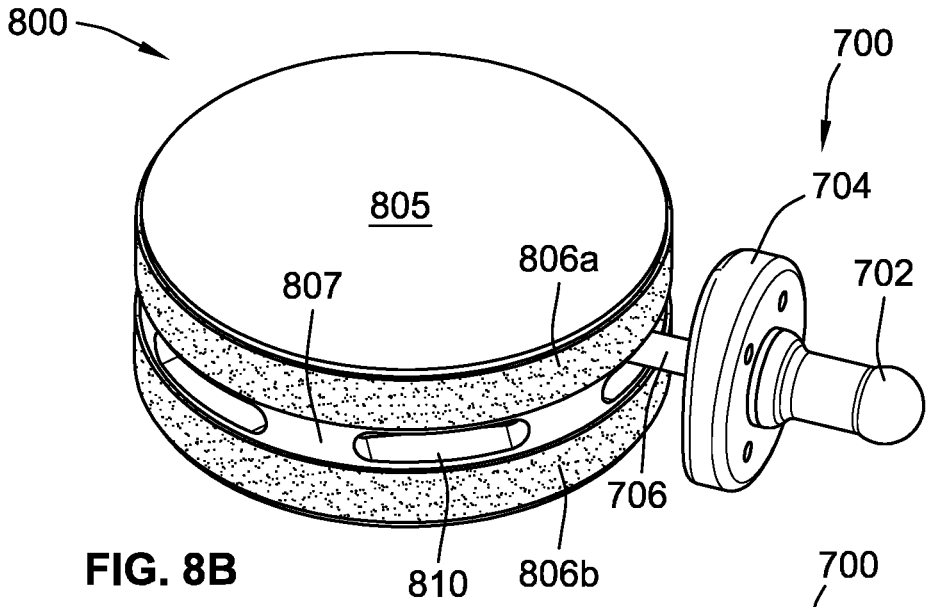
Figure 9B:
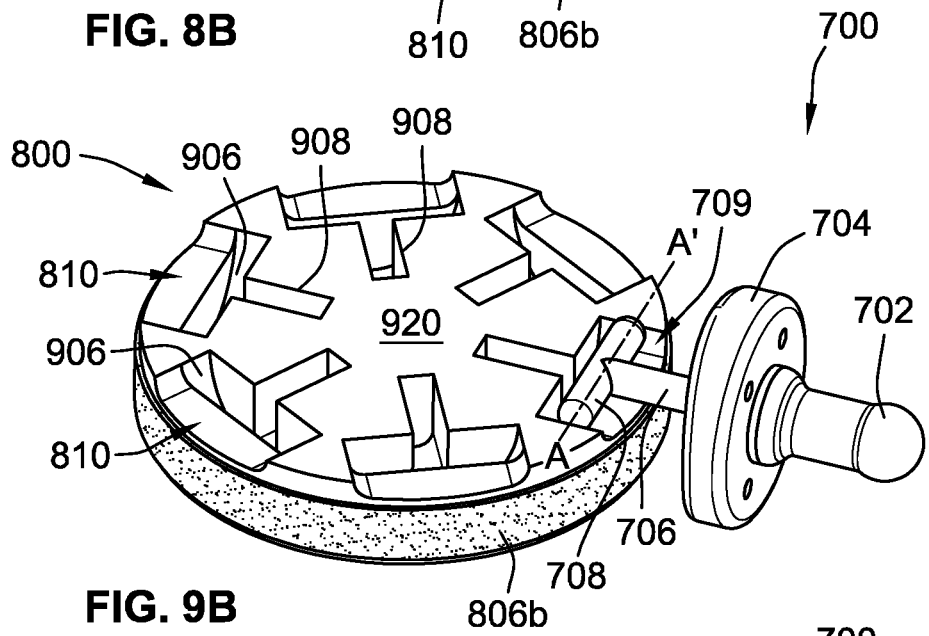
Figure 10B:
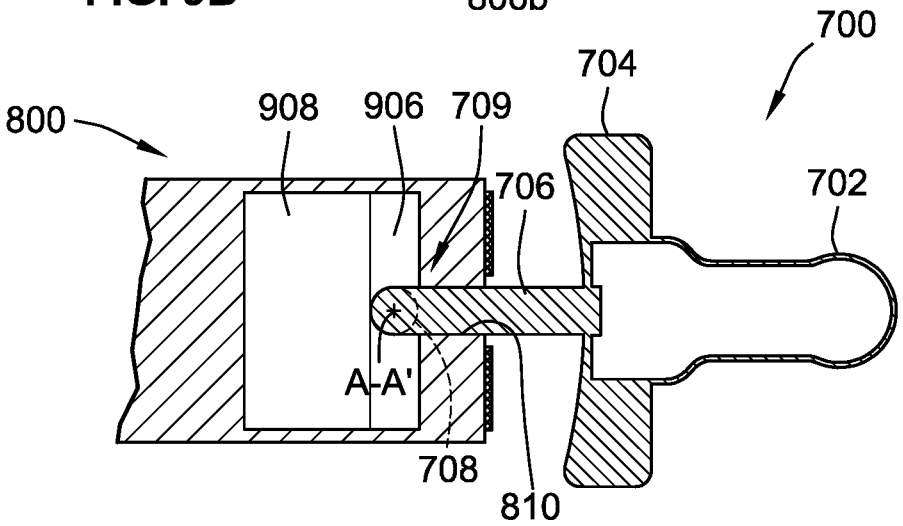
Figure 8C:
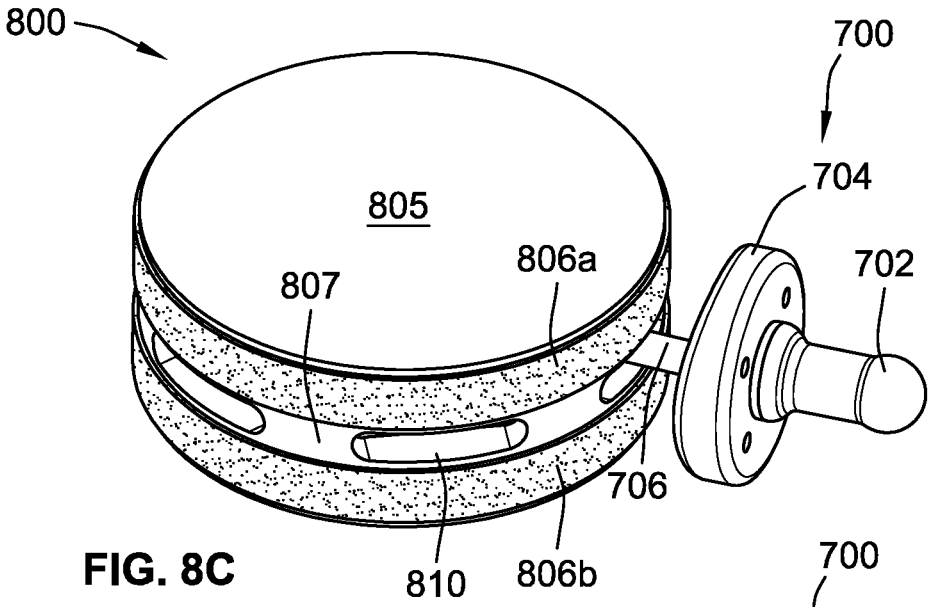
Figure 9C:
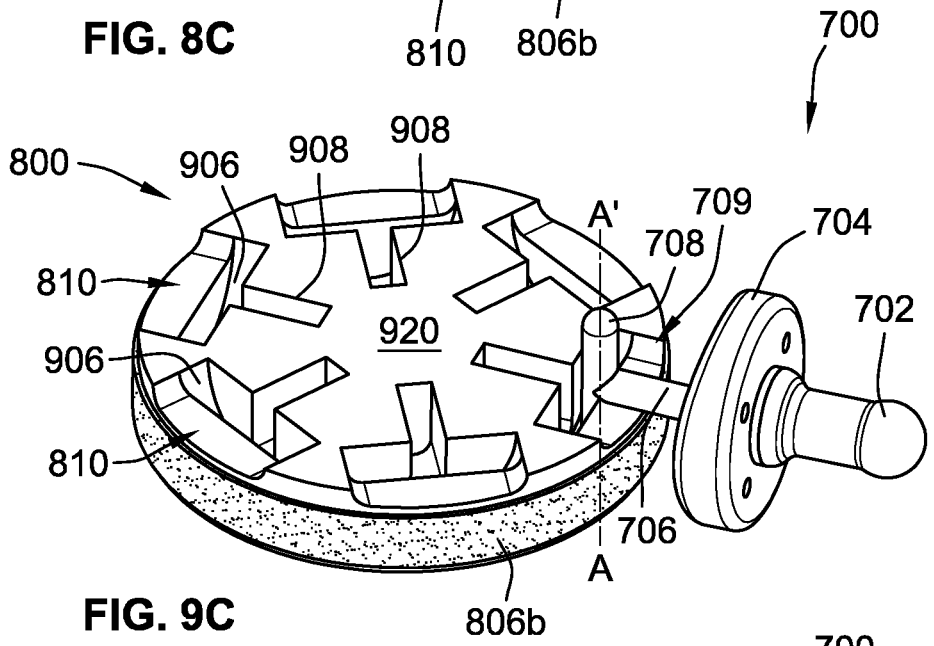

The cross-sectional views along a horizontal plane in FIGS. 10A-10D illustrate the movement of the attachment portion 709 which has a T-shape. As shown in FIG. 10A (and also reflected in FIGS. 8A and 9A), the linking members 706, 708 forming the T-shaped attachment portion 709 are initially at a distance from the slot 810, with the longitudinal axis A-A' of the linking member 708 being parallel to the horizontal plane and perpendicular to the vertical plane (A-A' coming out of the page). Then, as shown in FIG. 10B (and also reflected in FIGS. 8B and 9B), the linking members 706, 708 forming the T-shaped attachment portion 709 are received in the slot 810 such that the linking member 708 reaches the end of the first chamber 906.

Figure 10C:
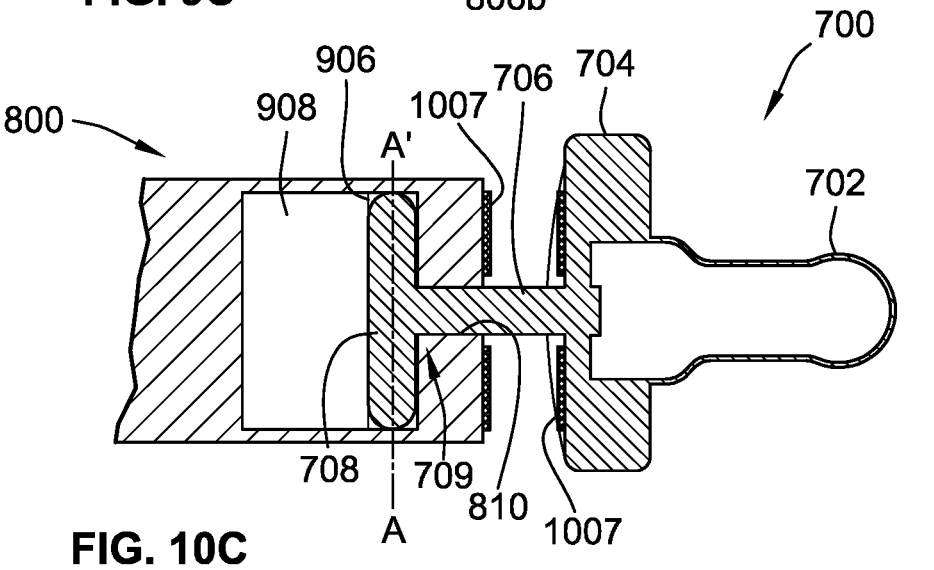
Figure 8D:
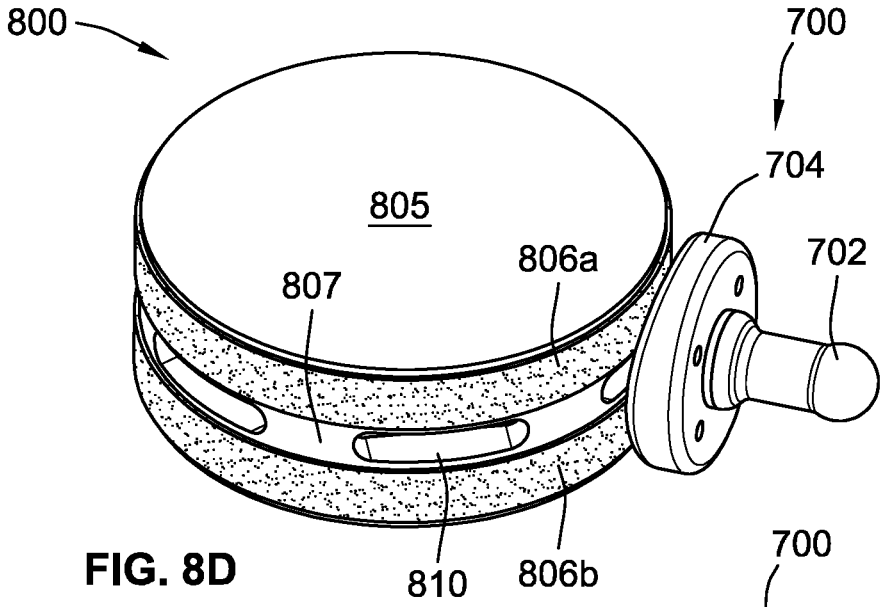
Figure 9D:
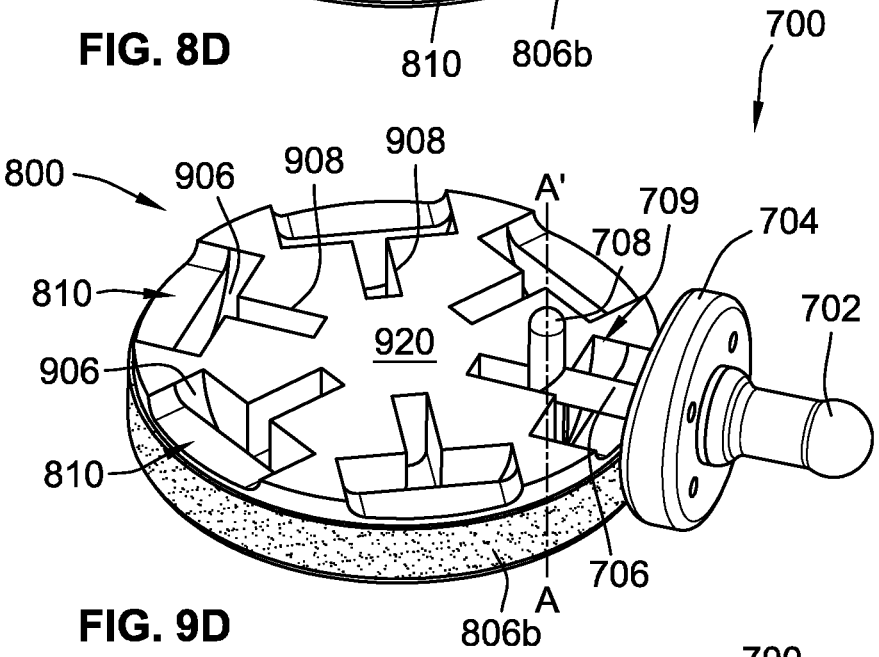

Subsequently, as shown in FIG. 10C (and also reflected in FIGS. 8C and 9C), the attachment portion 709 is rotated (e.g., by about 90 degrees) such that the longitudinal axis A-A' of the linking member 708 is now aligned along the vertical plane. The rotating movement of the attachment portion 709 also enables one or more strips 1007 of hook-and-loop fasteners (e.g., Velcro®) on the outer surface 807 of the body 805 to align with the one or more strips 705 of hook-and-loop fasteners on the rear surface 704*b* of the pacifier device 700.

Figure 10D:
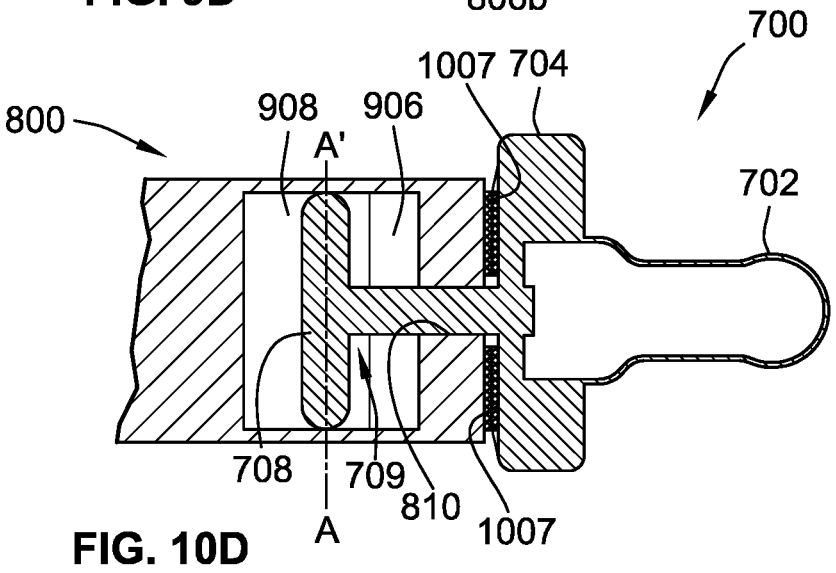

Finally, as shown in FIG. 10D (and also reflected in FIGS. 8D and 9D), the linking member 708 is further pressed into the second chamber 908 such that the attachment portion 709 is locked into the second chamber 908 and the one or more strips 705 of hook-and-loop fasteners attaches to the one or more strips 1007 of hook-and-loop fasteners to further secure the attachment portion 709 in the slot 810. Notably, in some implementations, the rear surface 704*b* of the base portion 704 includes a curved portion configured to abut a correspondingly-curved portion of the outer surface 807 of the body 805 when the one or more strips 705 of hook-and-loop fasteners are aligned with the one or more strips 1007 of hook-and-loop fasteners. In the example implementation shown in FIGS. 8A-10D, the rear surface 704*b* of the base portion 704 has an inwardly concave shape to accommodate the cylindrical outer surface 807 of the body 805, after the attachment portion 709 has undergone the rotating movement.

Figure 11A:
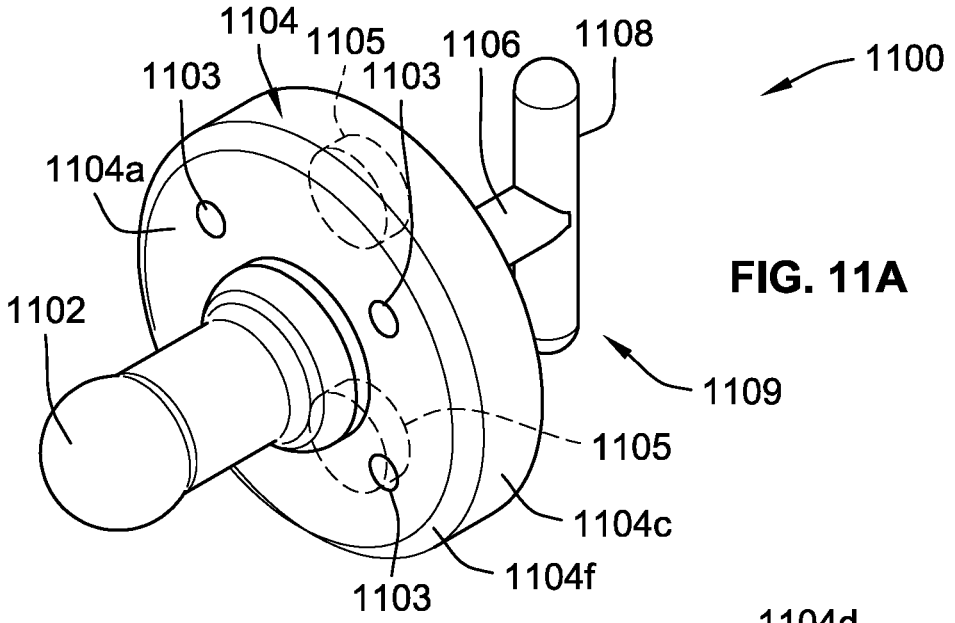
FIGS. 11A-11C shows front perspective, rear perspective, and cross-sectional perspective views respectively, of a pacifier device having a rotatable attachment portion and two magnetic pieces adjacent to a rear surface of the attachment portion, according to some implementations of the present disclosure.
Figure 11B:
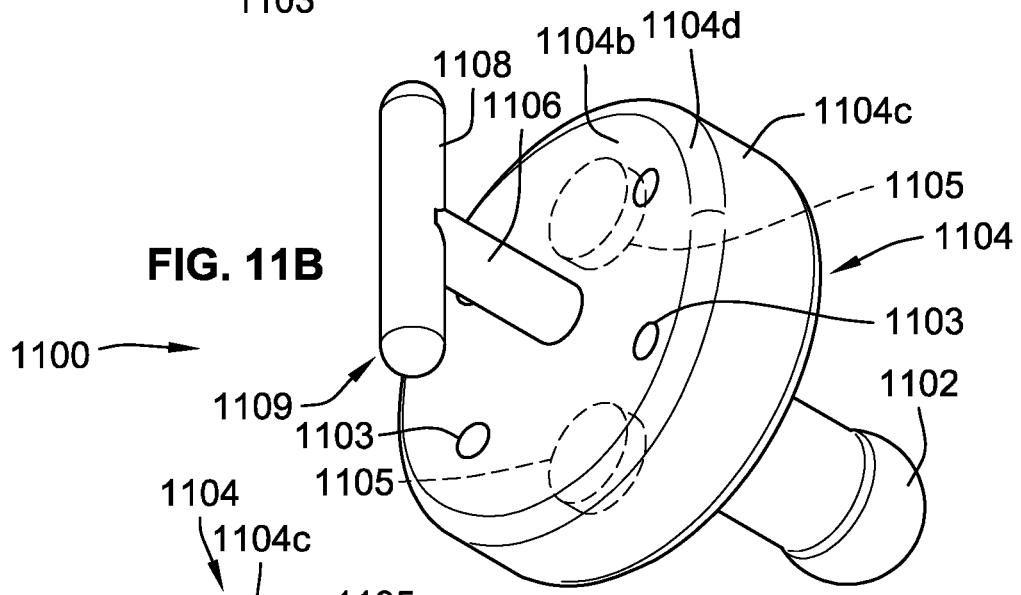
Figure 11C:
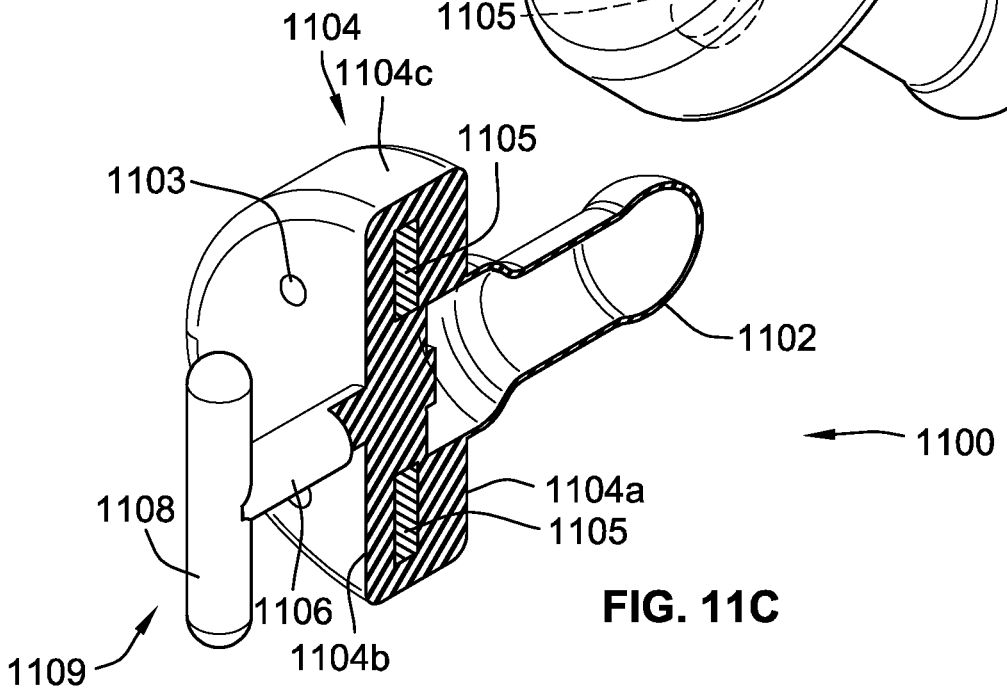
Figure 12A:
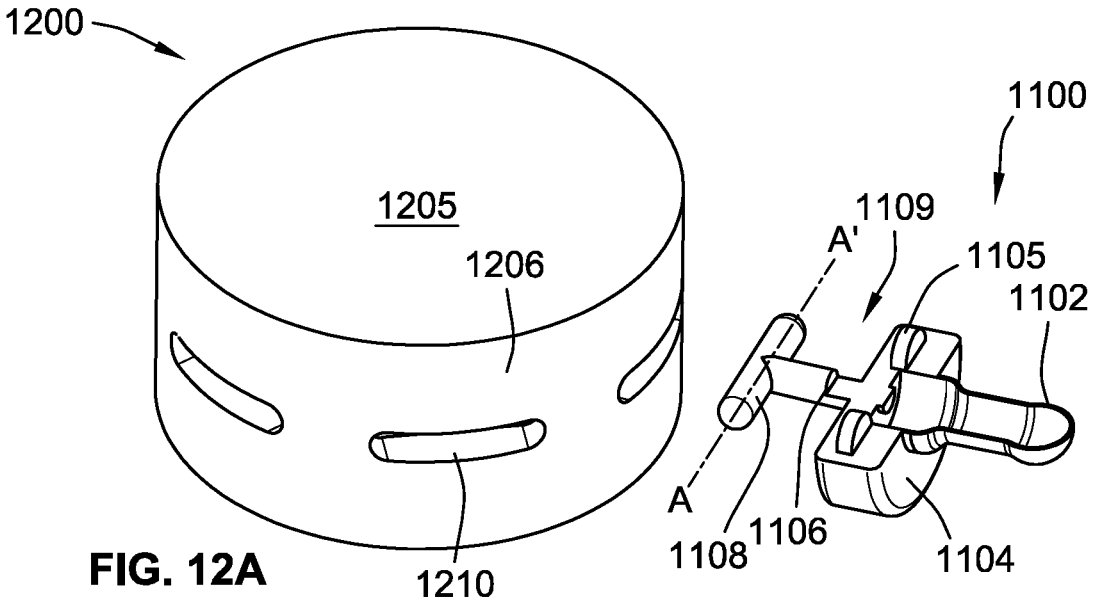
FIGS. 12A-12D show perspective views of four different stages of how the pacifier device of FIGS. 11A-11C fits into a slot on an outer surface of a body in a pacifier system, according to some implementations of the present disclosure.
Figure 13A:
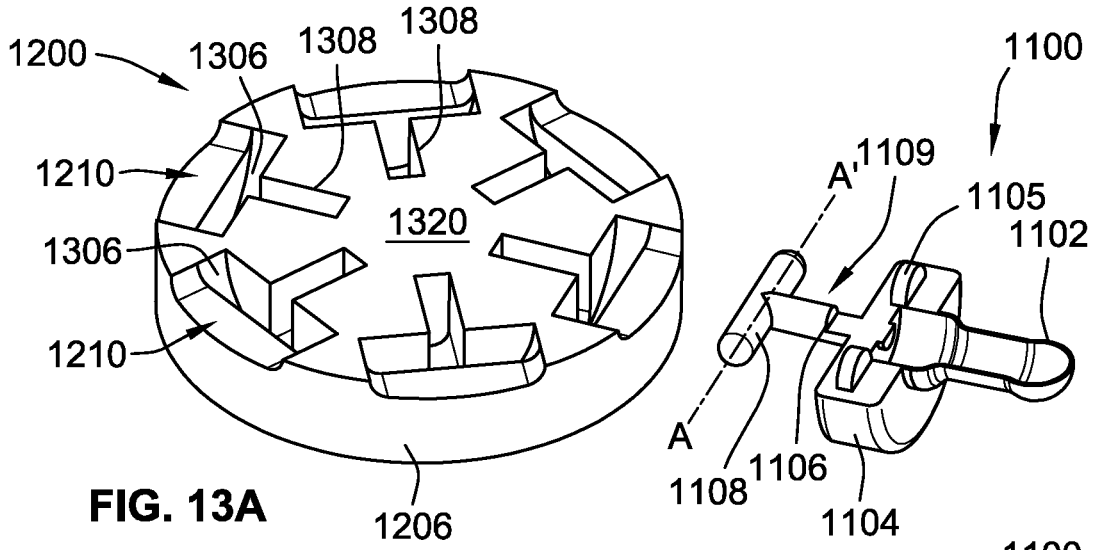
FIGS. 13A-13D show halved top perspective views of the four different stages of FIGS. 12A-12D, according to some implementations of the present disclosure.

FIGS. 11A-11C shows front perspective, rear perspective, and cross-sectional perspective views respectively, of a pacifier device 1100. The pacifier device 1100 has a nipple portion 1102, a base portion 1104, and an attachment portion 1109. In some implementations, the pacifier device 1100 including the nipple portion 1102, the base portion 1104, and the attachment portion 1109 form an integrated unit made of a single material such as, but not limited to, plastic, rubber, silicone, etc.

The base portion 1104 includes a front surface 1104*a*, a rear surface 1104*b*, and an outer surface 1104*c* between the front surface 1104*a* and the rear surface 1104*b*. In some implementations such as shown in FIGS. 11A-11C, the base portion 1104 has a chamfered front edge 1104*f* and a chamfered rear edge 1104*d*. The base portion 1104 includes breathing apertures 1103 through and between the front surface 1104*a* and the rear surface 1104*b*. The breathing apertures 1103 are substantially similar to the breathing apertures 412, 414 described above and provide ventilation while the pacifier device 1100 is being used by a baby.

In some implementations such as shown in FIGS. 11A-11C, a coupling mechanism including one or more magnetic pieces 1105 (e.g., having north or south polarity) (FIGS. 11A-11C show two magnetic pieces) are disposed adjacent to and just interior of the rear surface 1104*b* of the base portion 1104. The magnetic pieces 1105 are shaped, sized and positioned such that ventilation through the breathing apertures 1103 remains unhindered. The magnetic pieces 1105 are also positioned to couple the pacifier device 1100 to a suitable location for use by a baby.

The nipple portion 1102 is coupled to the base portion 1104 and extends in a first direction from the front surface 1104*a* of the base portion 1104. The nipple portion 1102 and the base portion 1104 are substantially similar to those of the first sucker 106 described with respect to FIG. 1-5 above, except that the pacifier device 1100 has the attachment portion 1109 formed by one or more linking members. The attachment portion 1109 is substantially similar in structure, and function to the attachment portion 709 described above, with respect to FIGS. 7A-7C.

In some implementations such as shown in FIGS. 11A-11C, the attachment portion 1109 generally has a T-shape formed by a first linking member 1106 attached to the rear surface 1104*b* of the base portion 1104 and a second linking member 1108 perpendicular to the first linking member 1106. In other implementations, the attachment portion 1109 may have a C-shape, Z-shape, L-shape, S-shape, X-shape, V-shape, Y-shape, and the like. The attachment portion 1109 is configured to be inserted into a slot positioned for using the pacifier device 1100. As discussed below, the attachment portion 1109 can only be inserted into the slot when in a first orientation but not when in a second orientation.

FIGS. 12A-12D, FIGS. 13A-13D, and FIGS. 14A-14D, when viewed in conjunction, fully illustrate four different stages of attaching the pacifier device 1100 to a body 1205 to form a pacifier system 1200. FIGS. 12A-12D show perspective views of the pacifier system 1200, while FIGS. 13A-13D show corresponding halved top perspective views and FIGS. 14A-14D show corresponding cross-sectional views along a horizontal plane. While in the implementations shown in FIGS. 12A-12D, the body 1205 is generally cylindrical in shape, it is contemplated that the body 1205 may have any three-dimensional shape such as, but not limited to, a cuboid, a cone, a sphere, and the like. The body 1205 has an outer surface 1206 is configured to magnetically attract the one or more magnetic pieces 1105 adjacent to and just interior of the rear surface 1104*b* of the base portion 1104. In the implementations shown in FIGS. 12A-12D, the outer surface 1206 of the body 1205 includes magnetic pieces 1405 having opposite polarity than the one or more magnetic pieces 1105 of the pacifier device 1100 such that the pacifier device 1100 can be attached to the body 1205.

The body 1205 has one or more slots 1210 disposed on the outer surface 1206. In some implementations, the body 1205 has a plurality of slots 1210 on the outer surface 1206. For example, in the implementation shown in FIGS. 13A-13D, the body 1205 has six slots 1210 around a central cavity 1320, though in other implementations, there may be more or less than six slots. Each slot 1210 is configured to accommodate and lock into position the pacifier device 1100. As shown in FIGS. 13A-13D, each slot 1210 opens into a first chamber 1306 and a second chamber 1308 positioned interior of the first chamber 1306 adjacent to the central cavity 1320. The first chamber 1306 is configured to receive the attachment portion 1109 of the pacifier device 1100, only when the attachment portion 1109 is in a first orientation (e.g., the longitudinal axis A-A' of the linking member 1108 being parallel to the horizontal plane), but not when the attachment portion 1109 is in a second orientation (e.g., the longitudinal axis A-A' of the linking member 1108 being perpendicular to the horizontal plane). The second chamber 1308 is configured to lock the attachment portion 1109 to the body 1205.

Figure 14A:
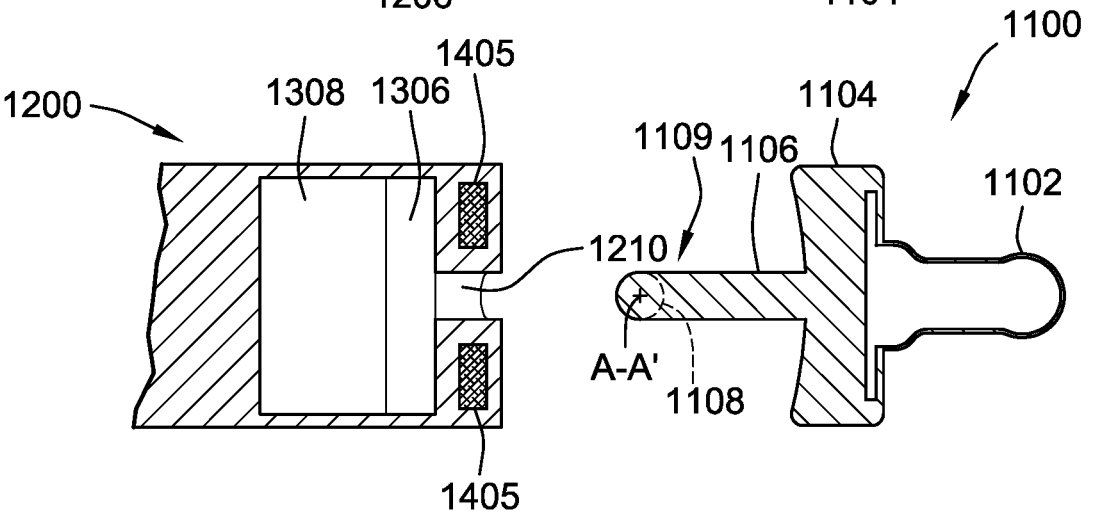
FIGS. 14A-14D show cross-sectional views along a horizontal plane of the four different stages of FIGS. 12A-12D, according to some implementations of the present disclosure.
Figure 12B:
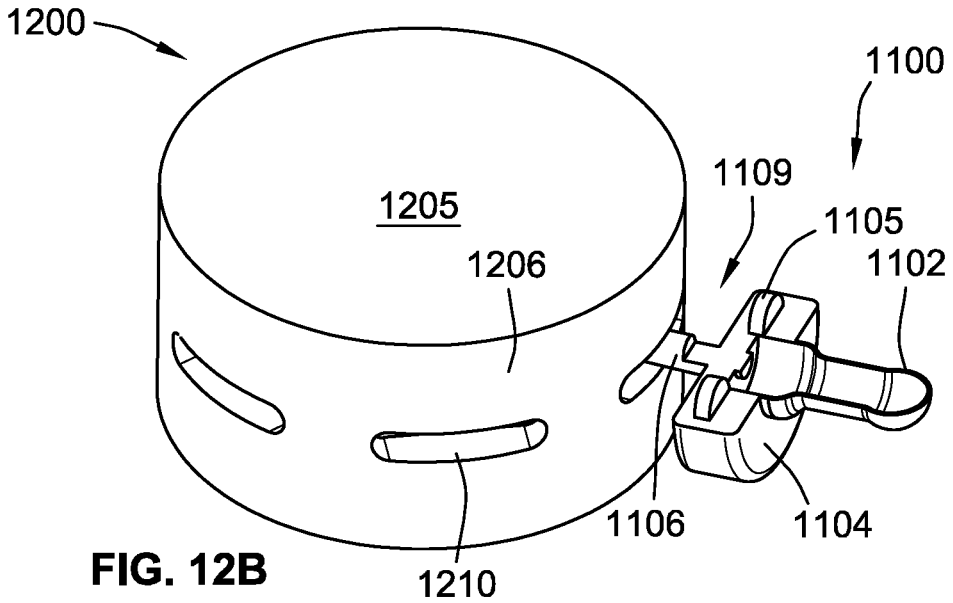
Figure 13B:
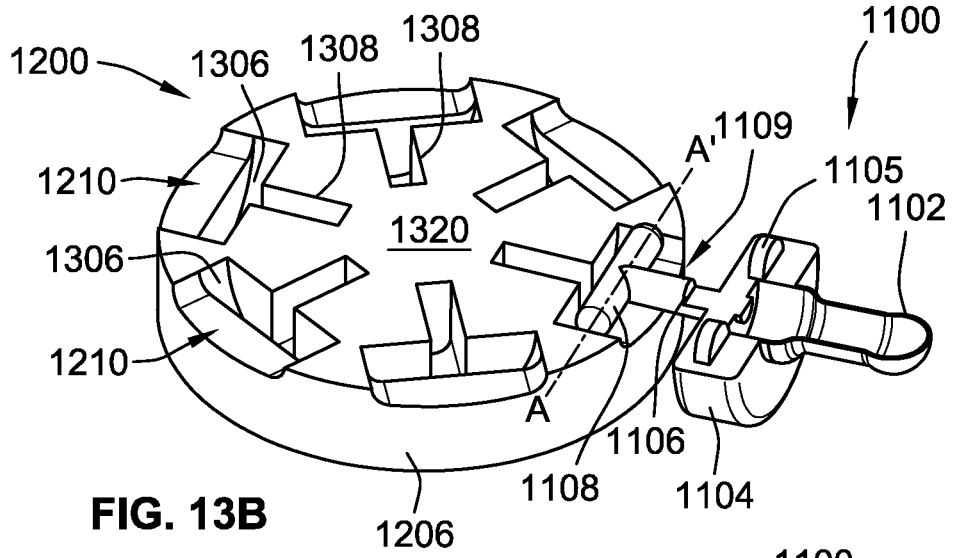
Figure 14B:
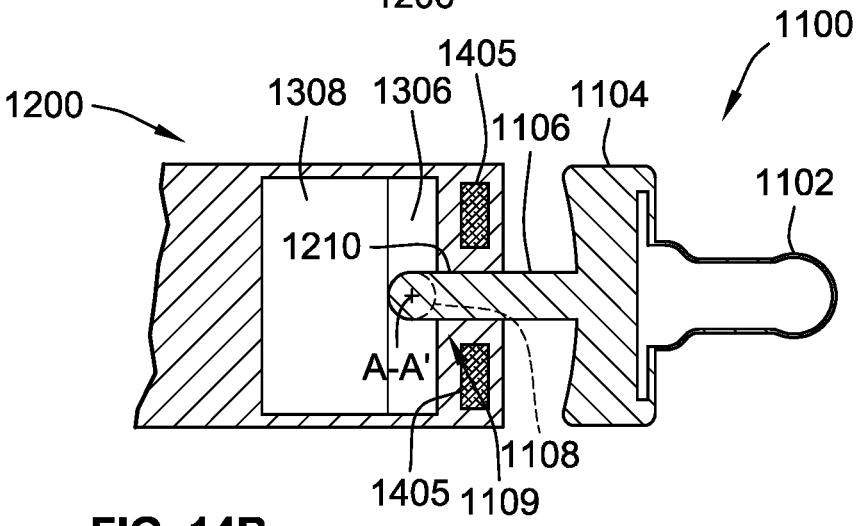
Figure 12C:
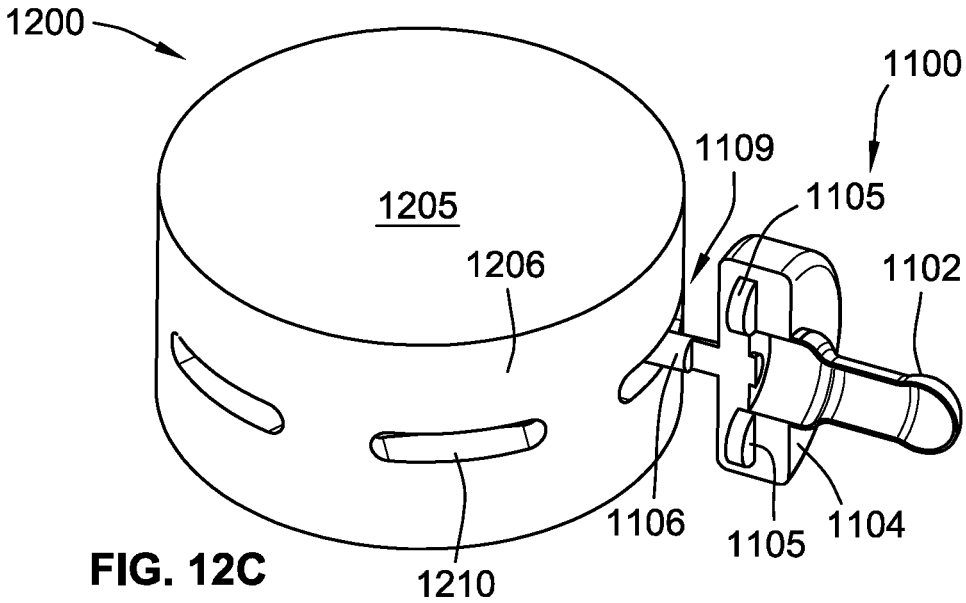
Figure 13C:
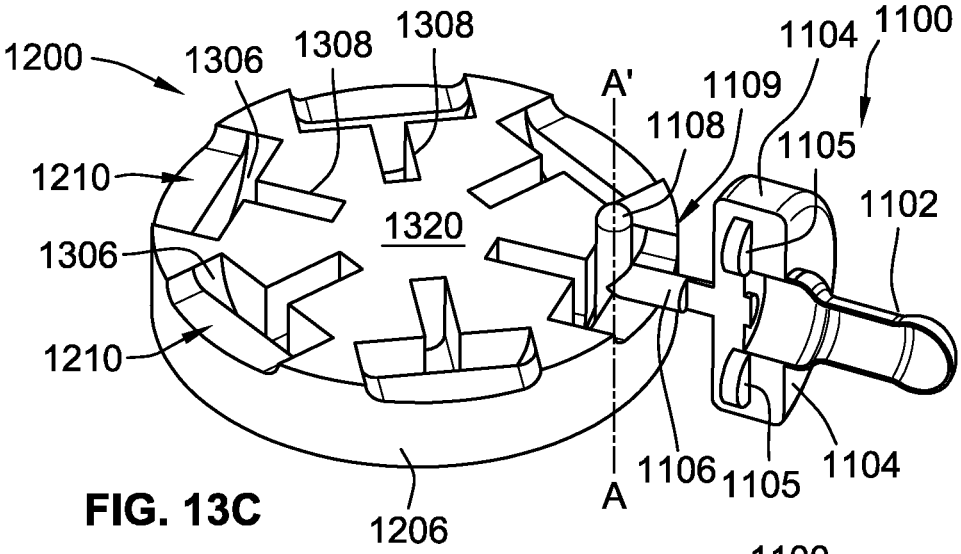

The cross-sectional views along a horizontal plane in FIGS. 14A-14D illustrate the movement of the attachment portion 1109 which has a T-shape. As shown in FIG. 14A (and also reflected in FIGS. 12A and 13A), the linking members 1106, 1108 forming the T-shaped attachment portion 1109 are initially at a distance from the slot 1210, with the longitudinal axis A-A' of the linking member 1108 being parallel to the horizontal plane and perpendicular to the vertical plane (A-A' coming out of the page). Then, as shown in FIG. 14B (and also reflected in FIGS. 12B and 13B), the linking members 1106, 1108 forming the T-shaped attachment portion 1109 are received in the slot 1210 such that the linking member 1108 reaches the end of the first chamber 1306.

Figure 14C:
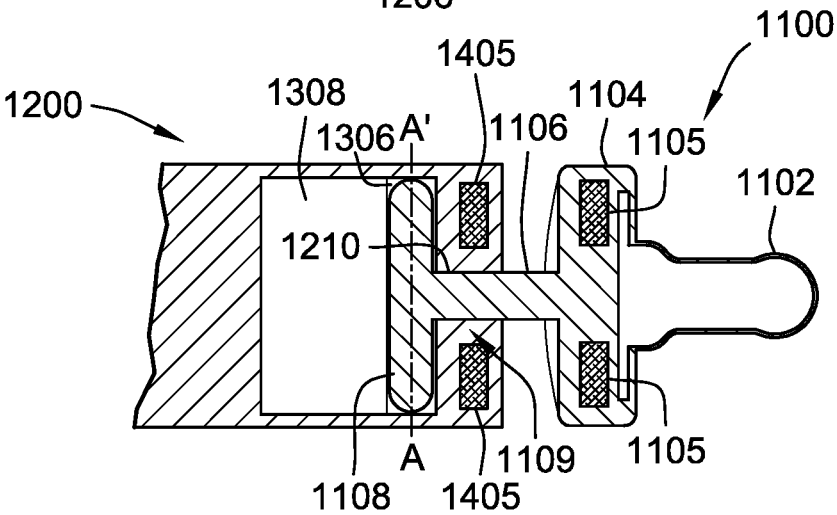
Figure 12D:
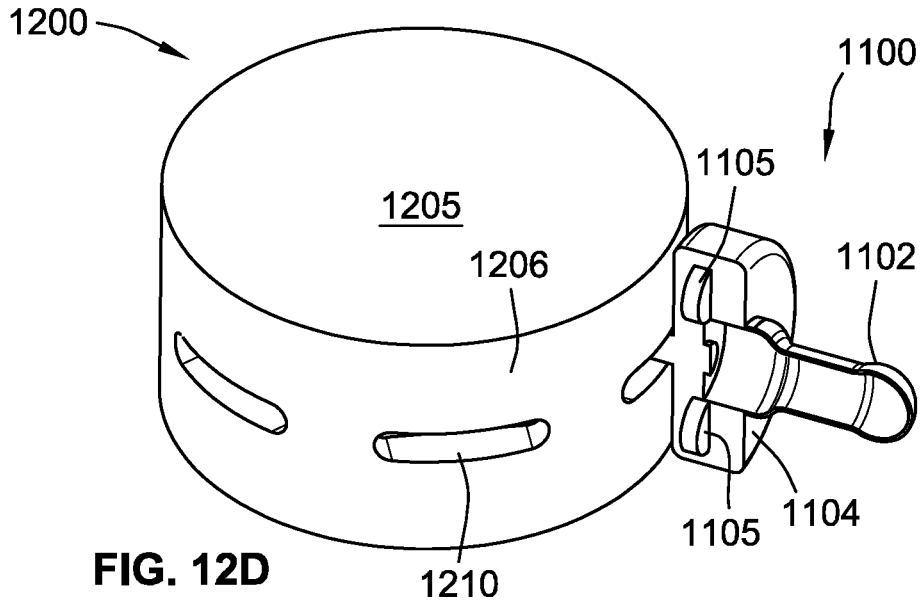
Figure 13D:
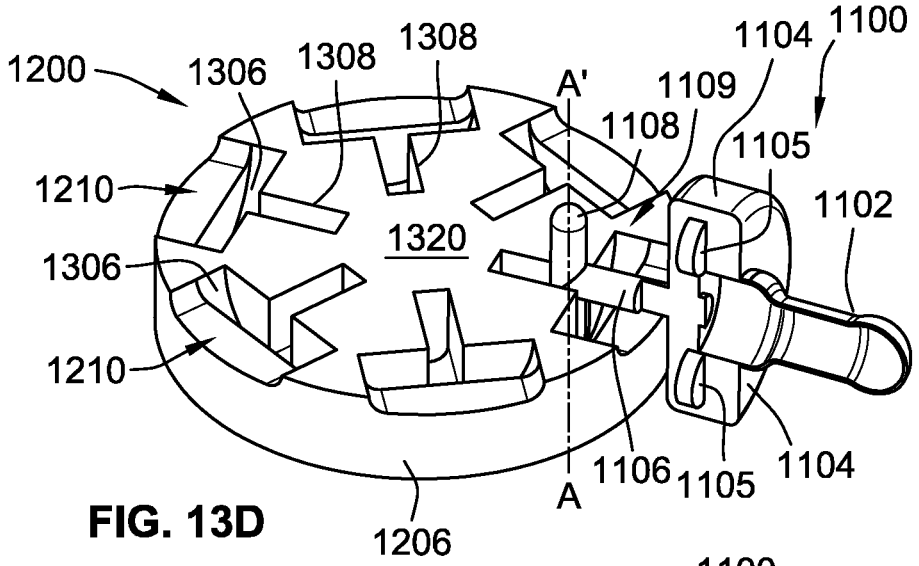

Subsequently, as shown in FIG. 14C (and also reflected in FIGS. 12C and 13C), the attachment portion 1109 is rotated (e.g., by about 90 degrees) such that the longitudinal axis A-A' of the linking member 1108 is now aligned along the vertical plane. The rotating movement of the attachment portion 1109 also enables the one or more magnetic pieces 1405 on the outer surface 1206 of the body 1205 to align with and attracted to the one or more magnetic pieces 1105 having opposite polarity and disposed on the rear surface 1104*b* of the pacifier device 1100.

Figure 14D:
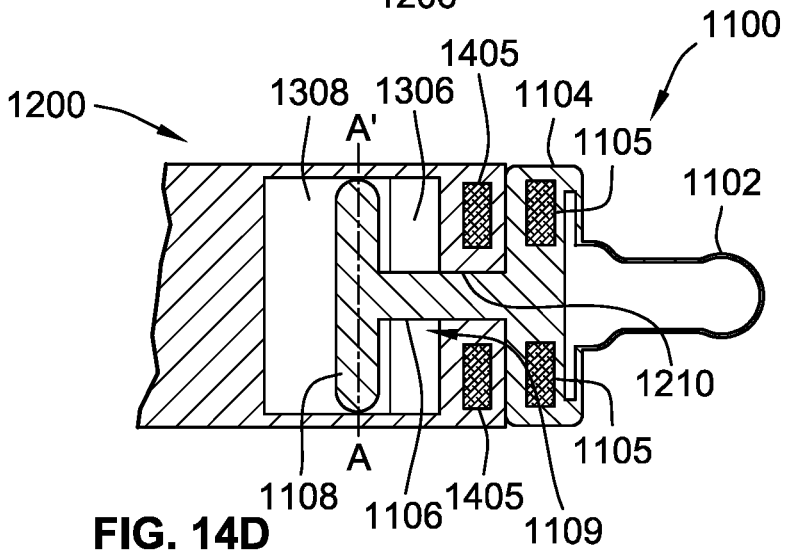

Finally, as shown in FIG. 14D (and also reflected in FIGS. 12D and 13D), the linking member 1108 is further pressed into the second chamber 1308 such that the attachment portion 1109 is locked into the second chamber 1308 and the one or more magnetic pieces 1105 attaches to the one or more magnetic pieces 1405 to further secure the attachment portion 1109 in the slot 1210. Notably, in some implementations, the rear surface 1104*b* of the base portion 1104 includes a curved portion configured to abut a correspondingly-curved portion of the outer surface 1206 of the body 1205 when the one or more magnetic pieces 1105 are aligned with the one or more magnetic pieces 1405. In the example implementation shown in FIGS. 12A-14D, the rear surface 1104*b* of the base portion 1104 has an inwardly concave shape to accommodate the cylindrical outer surface 1206 of the body 1205, after the attachment portion 1109 has undergone the rotating movement.

Figure 15A:
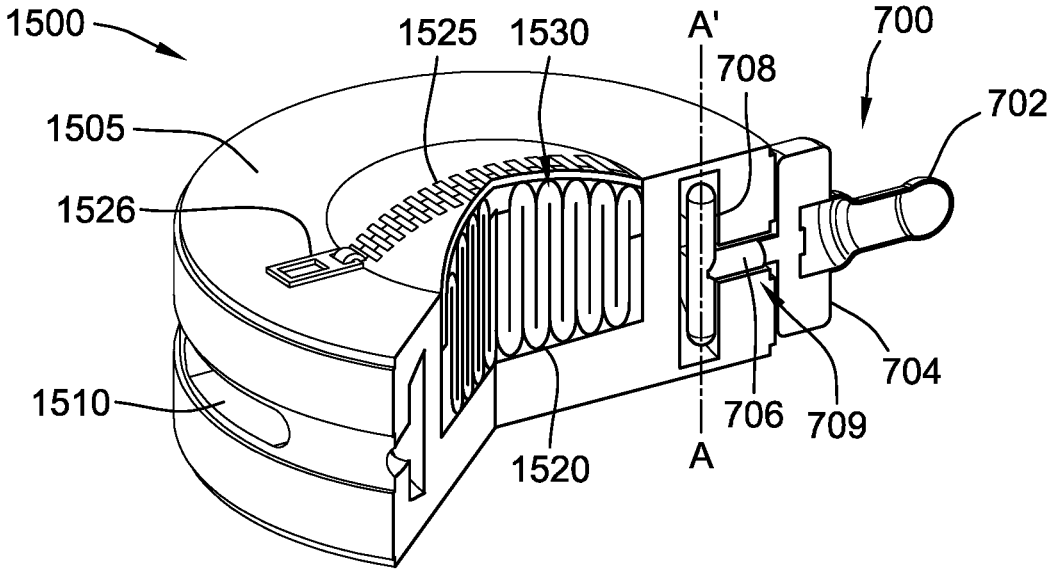
FIG. 15A shows a halved perspective view of a bag sealably stored within a central cavity of the body of the pacifier system, according to some implementations of the present disclosure.
Figure 15B:
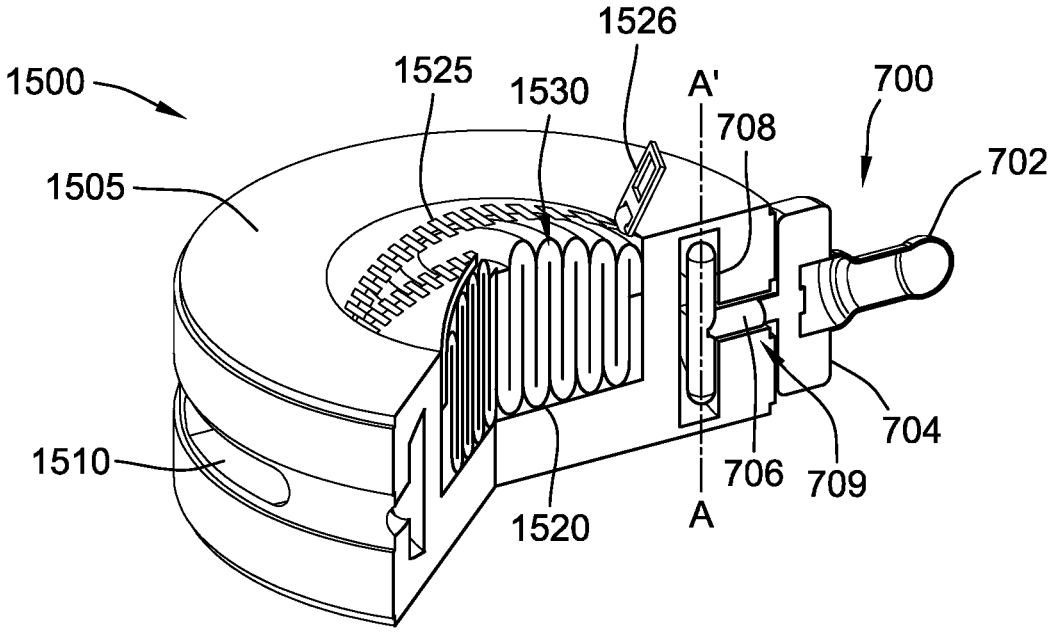
FIG. 15B shows a halved perspective view of the bag of FIG. 15A in a compressed state when the central cavity is unsealed, according to some implementations of the present disclosure.

FIGS. 15A-15B show halved perspective views of an implementation of a pacifier system 1500 (similar to the pacifier systems 800 and 1200), where a bag 1530 is sealably stored within a central cavity 1520 of the body 1505 of the pacifier system 1500. The bag 1530 is coupled to the central cavity 1520 (e.g., coupled to a wall, coupled to an edge) and sealed inside the central cavity 1520 by a zipper 1525 having a handle 1526. It is contemplated that the bag 1530 may be sealed within the central cavity 1520 using a number of ways other than the zipper 1525. The bag 1530 may be formed from any synthetic or natural materials such as, but not limited to, wool, cotton, nylon, spandex, polyester, leather, plastic, rubber, mixed compositions of these materials, and combinations of these. FIG. 15B shows a halved perspective view of the bag 1530 in a compressed state. The central cavity 1520 is left opened by pulling the zipper 1525.

Figure 15C:
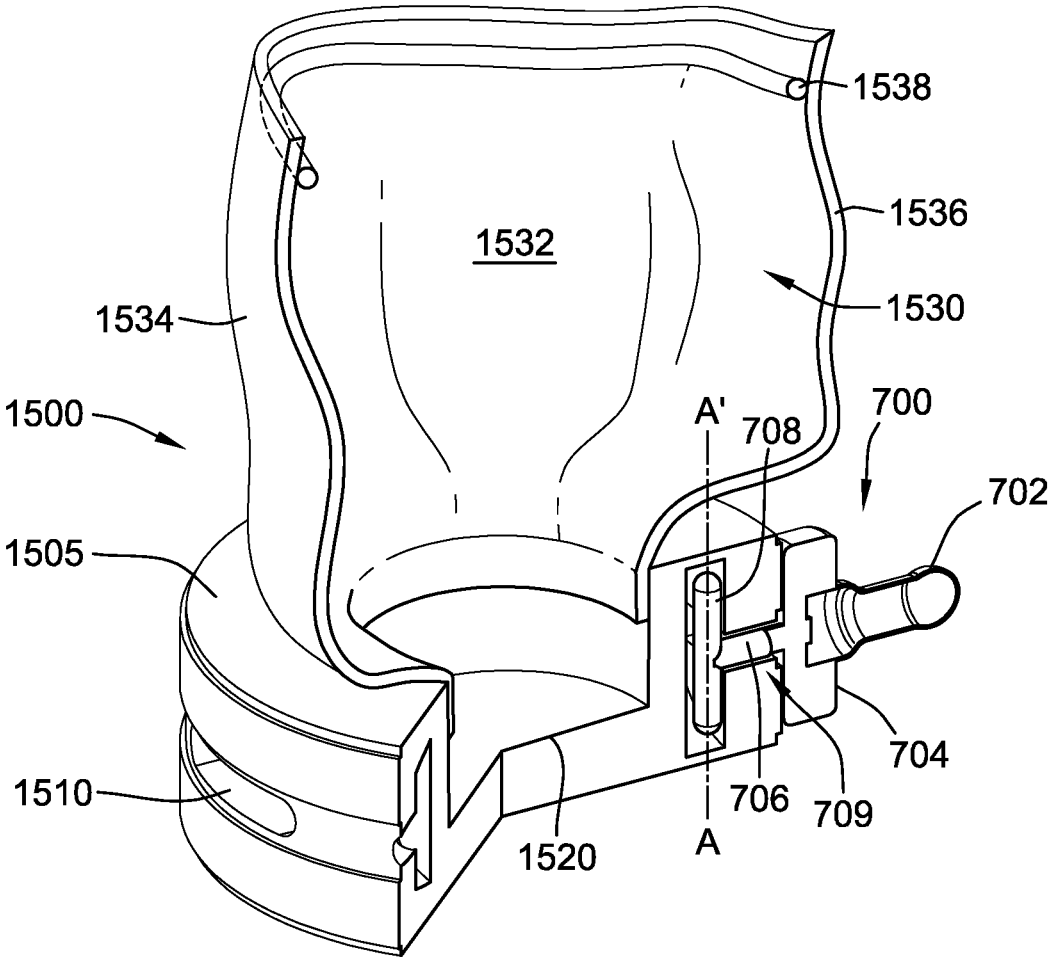
FIG. 15C shows a halved perspective view of the bag of FIG. 15B in a decompressed state, according to some implementations of the present disclosure.
Figure 15D:
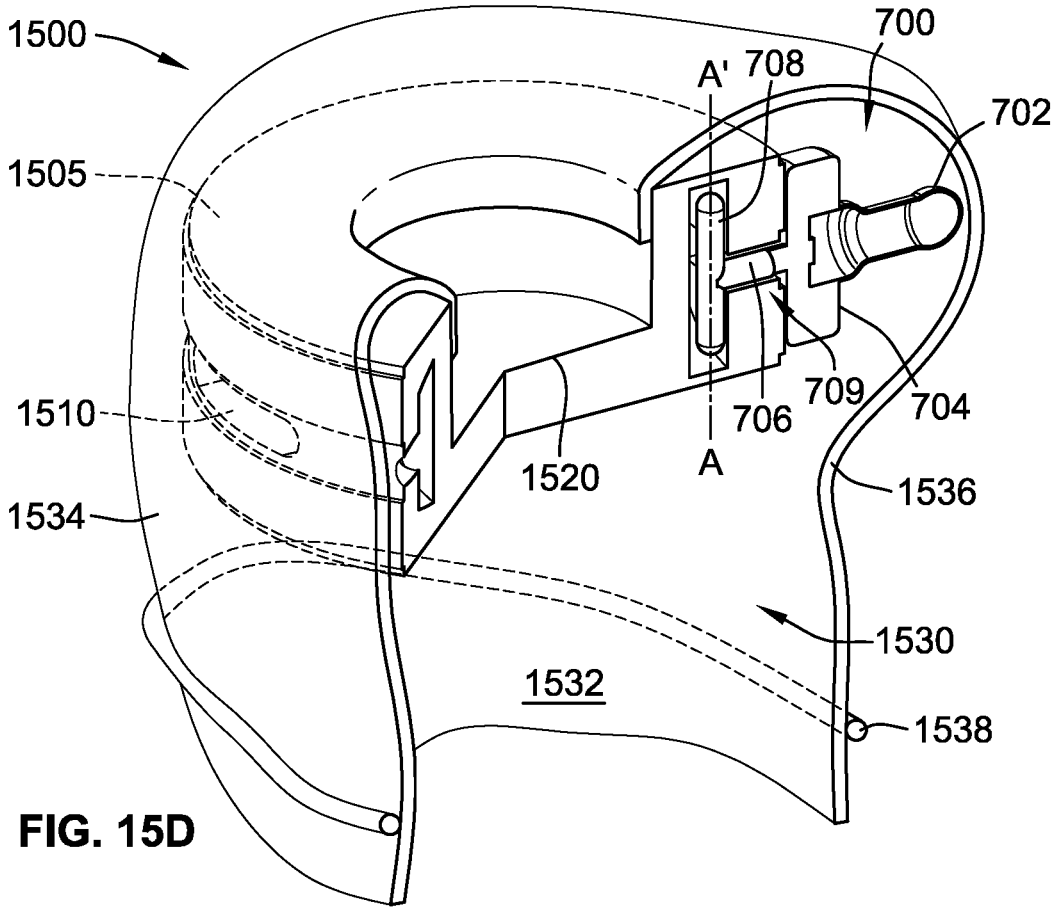
FIG. 15D shows a halved perspective view of the bag of FIG. 15C enveloping the pacifier system, according to some implementations of the present disclosure.
Figure 15E:
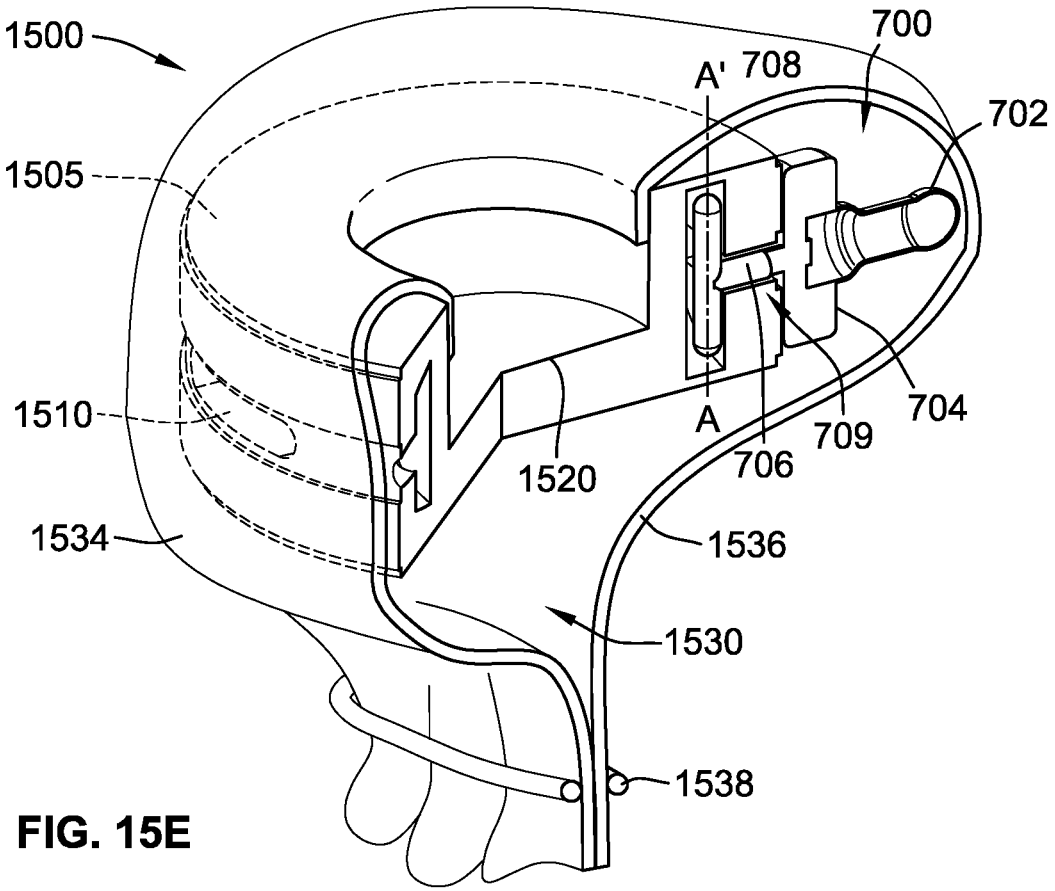
FIG. 15E shows a halved perspective view of the bag of FIG. 15D tightened by a drawstring, according to some implementations of the present disclosure.

FIG. 15C shows a halved perspective view of the bag 1530 in a decompressed state, after the bag 1530 has been pulled from the central cavity 1520. The bag 1530 has an interior surface 1532 and an exterior surface 1534 on either side of an edge 1536. A drawstring 1538 is coupled to the exterior surface 1534. When in decompressed state, the bag 1530 can be used to envelope the body 1505, the pacifier device 700 coupled to the body 1505 by placing the attachment portion 709 through slots 1510 in the body 1505. FIG. 15D shows a halved perspective view of the bag 1530 enveloping the pacifier system 1500 and its components—the body 1505 and the pacifier device 700. The envelope over the pacifier system 1500 can be tightened by pulling the drawstring 1538, as shown in FIG. 15E. This secures the components of the pacifier system 1500 in a covering when not in use, thereby preventing exposure to dirt, dust, and other harmful effects.

Figure 16A:
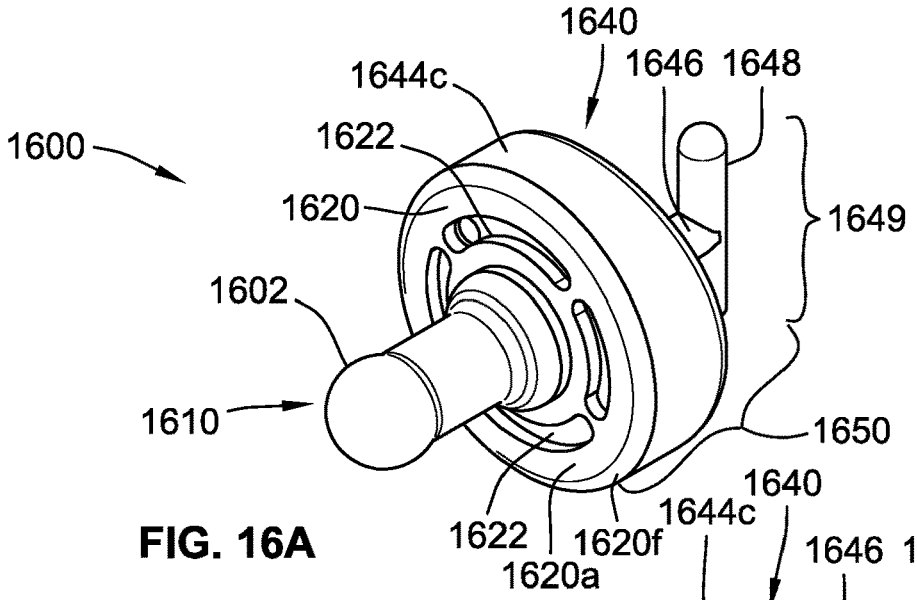
FIGS. 16A-16C show front perspective, exploded front perspective, and cross-sectional views respectively, of a first embodiment of a pacifier device having an adapter with a compartment for accommodating a sucker and an attachment portion coupled to the compartment, according to some implementations of the present disclosure.
Figure 16B:
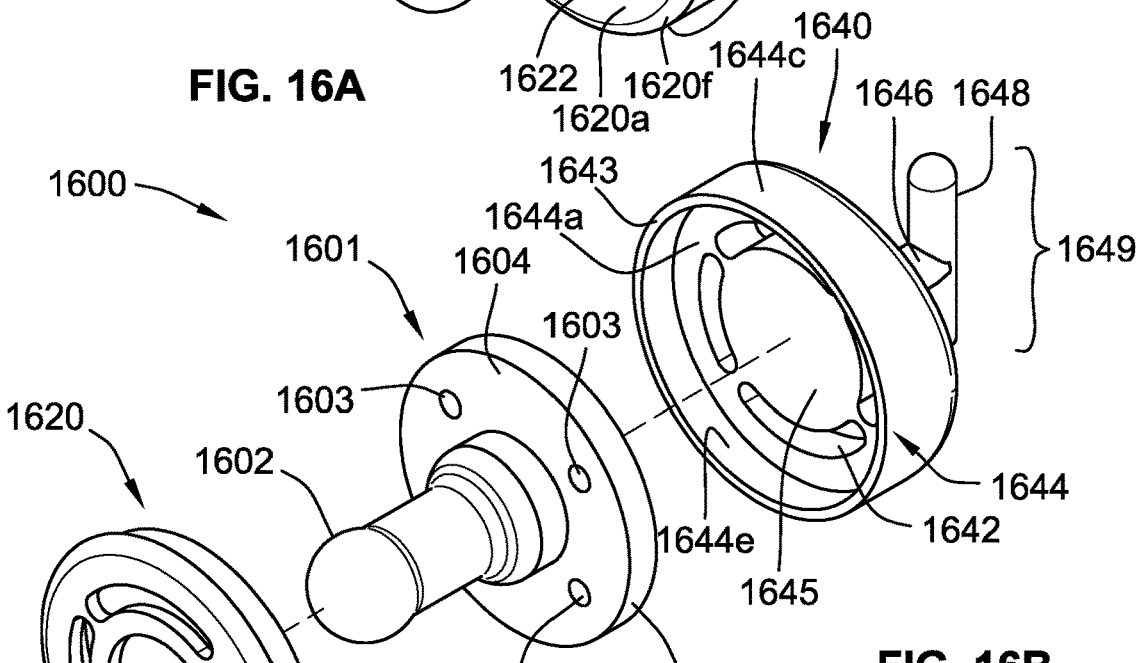
Figure 16C:
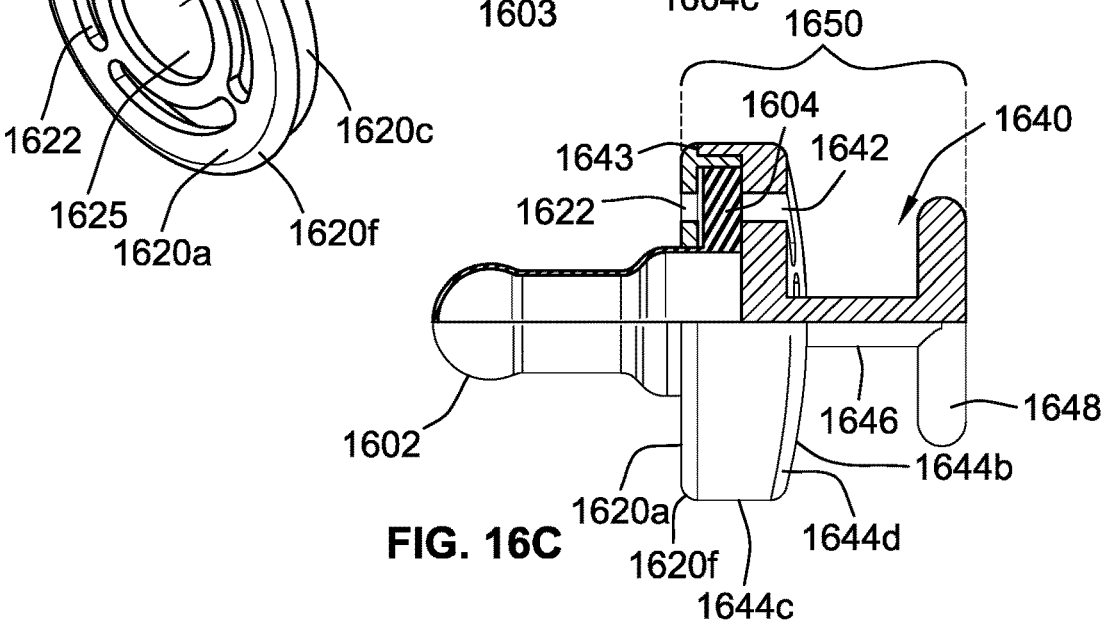

FIGS. 16A-16C show front perspective, exploded front perspective, and cross-sectional views respectively, of a first embodiment of a pacifier device 1600 having a sucker 1601 and an adapter 1650. The adapter 1650 includes an attachment portion 1649 and a compartment 1640 for accommodating the sucker 1601. The attachment portion 1649 is coupled to the compartment 1640. The pacifier device 1600 can be used independently or coupled to a body (e.g., body 805, body 1205) to form a pacifier system, such as those described above. Additionally, the compartment 1640 can be used to accommodate soft toys and other playful things, and then coupled to the body using the attachment portion 1649.

The sucker 1601 has a nipple portion 1602 and a base portion 1604 protruding therefrom. The base portion 1604 includes a front surface 1604*a*, a rear surface 1604*b*, and an outer surface 1604*c* between the front surface 1604*a* and the rear surface 1604*b*. The base portion 1604 includes breathing apertures 1603 through and between the front surface 1604*a* and the rear surface 1604*b*. The breathing apertures 1603 are substantially similar to the breathing apertures 703 described above.

The nipple portion 1602 is coupled to the base portion 1604 and extends in a first direction from the front surface 1604*a* of the base portion 1604. The nipple portion 1602 and the base portion 1604 are substantially similar to those of the first sucker 106 described with respect to FIG. 1-5 above, but does not include an attachment portion.

The compartment 1640 is generally cylindrical in shape, though other shapes such as a cuboid, a sphere, etc. are also contemplated. The compartment 1640 is designed to accommodate the sucker 1601 in a protruding orientation. The compartment 1640 includes a central cavity 1645 surrounded by a wall 1644 with a rim 1643. The wall 1644 has an outer surface 1644*c* and an inner surface 1644*e*. The central cavity 1645 has a bottom surface 1644*a* that contacts the rear surface 1604*b* of base portion 1604 of the sucker 1601, when the sucker 1601 is placed in the compartment 1640. The bottom surface 1644*a* includes one or more vents 1642 to align with the breathing apertures 1603 on the rear surface 1604*b* of base portion 1604 of the sucker 1601. The compartment 1640 further includes a rear surface 1644*b*. In some implementations, the rear surface 1644*b* may have a chamfered rear edge 1644*d*.

The adapter 1650 includes a lid 1620 for sealably closing the compartment 1640. The lid 1620 includes a central opening 1625 through which the nipple portion 1602 can be accommodated, when the sucker 1601 is placed in the compartment 1640. The lid 1620 also includes one or more vents 1622 that align with the breathing apertures 1603 of the sucker 1601, when the lid 1620 is placed over the compartment 1640 and the nipple portion 1602 is in the protruding orientation. The lid 1620 has a front surface 1620*a*, a rear surface (not shown), and an outer surface 1620*c*. In some implementations, the front surface 1620*a* may have a chamfered front edge 1620*f*.

In the implementation shown in FIGS. 16A-16C, the lid 1620 is a separate piece from the compartment 1640. The lid 1620 may be coupled to the compartment 1640 using one or more of a connection between a clip on the lid 1620 and a notch on the rim 1643, a hinge between the lid 1620 and the rim 1643, an interference fit between the lid 1620 and the rim 1643, a magnetic fit between the lid 1620 and the rim 1643, fasteners between the lid 1620 and the rim 1643, or any combination thereof. In the implementation shown in FIGS. 16A-16C, the lid 1620 forms an interference fit with the rim 1643 of the compartment 1640, whereby the diameter of the outer surface 1620*c* is greater than the diameter of the wall 1644*c* surrounding the central cavity 1645 of the compartment 1640 such that frictional forces can press the lid 1620 over the compartment 1640. In other implementations, the interference fit between the lid 1620 and the rim 1643 of the compartment 1640 may be achieved using a channel with dimples around the rim 1643 over which the lid 1620 can be snapped onto, and other similar mechanisms.

In some implementations, the attachment portion 1649 is coupled to the rear surface 1644*b* of the compartment 1640 and extends in a direction opposite to the direction along which the nipple portion 1602 of the sucker 1601 protrudes from the compartment 1640. In other implementations, the attachment portion 1649 may extend from the compartment 1640 at an angle with respect to the direction along which the nipple portion 1602 protrudes, such as from a side of the compartment 1640. In some implementations, the attachment portion 1649 is detachable from the compartment 1640. In some implementations such as shown in FIGS. 16A-16C, the attachment portion 1649 generally has a T-shape formed by a first linking member 1646 attached to the rear surface 1644*b* of the compartment 1640 and a second linking member 1648 perpendicular to the first linking member 1646. In other implementations, the attachment portion 1649 may have a C-shape, Z-shape, L-shape, S-shape, X-shape, V-shape, Y-shape, and the like. It is contemplated that the pacifier device 1600 may be secured to a body or a hub (e.g., body 805, body 1105) to form a pacifier system.

Figure 17A:
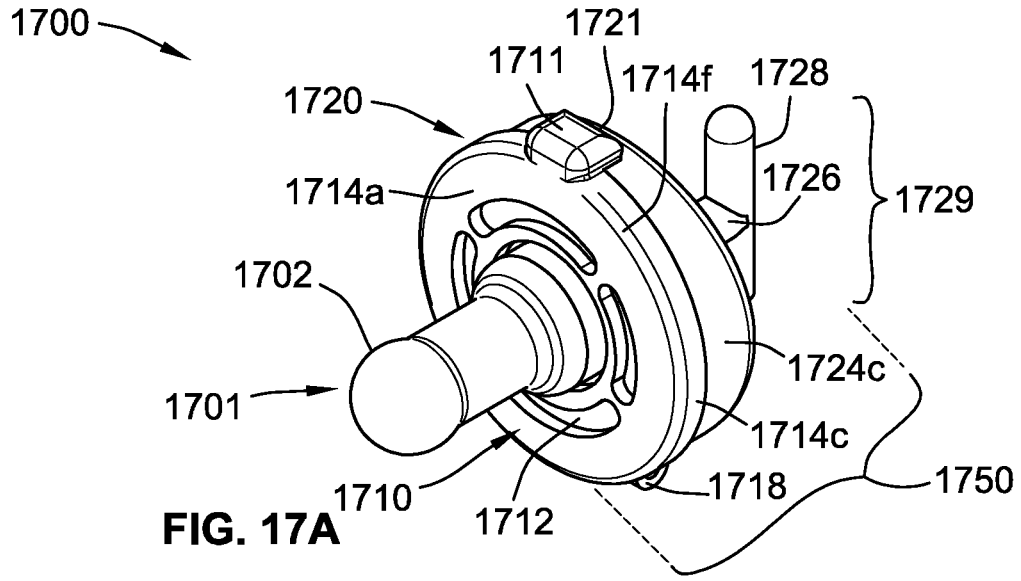
FIGS. 17A-17B show front perspective and exploded front perspective views respectively, of a second embodiment of a pacifier device having an adapter with a compartment for accommodating a sucker and an attachment portion coupled to the compartment, according to some implementations of the present disclosure.
Figure 17B:
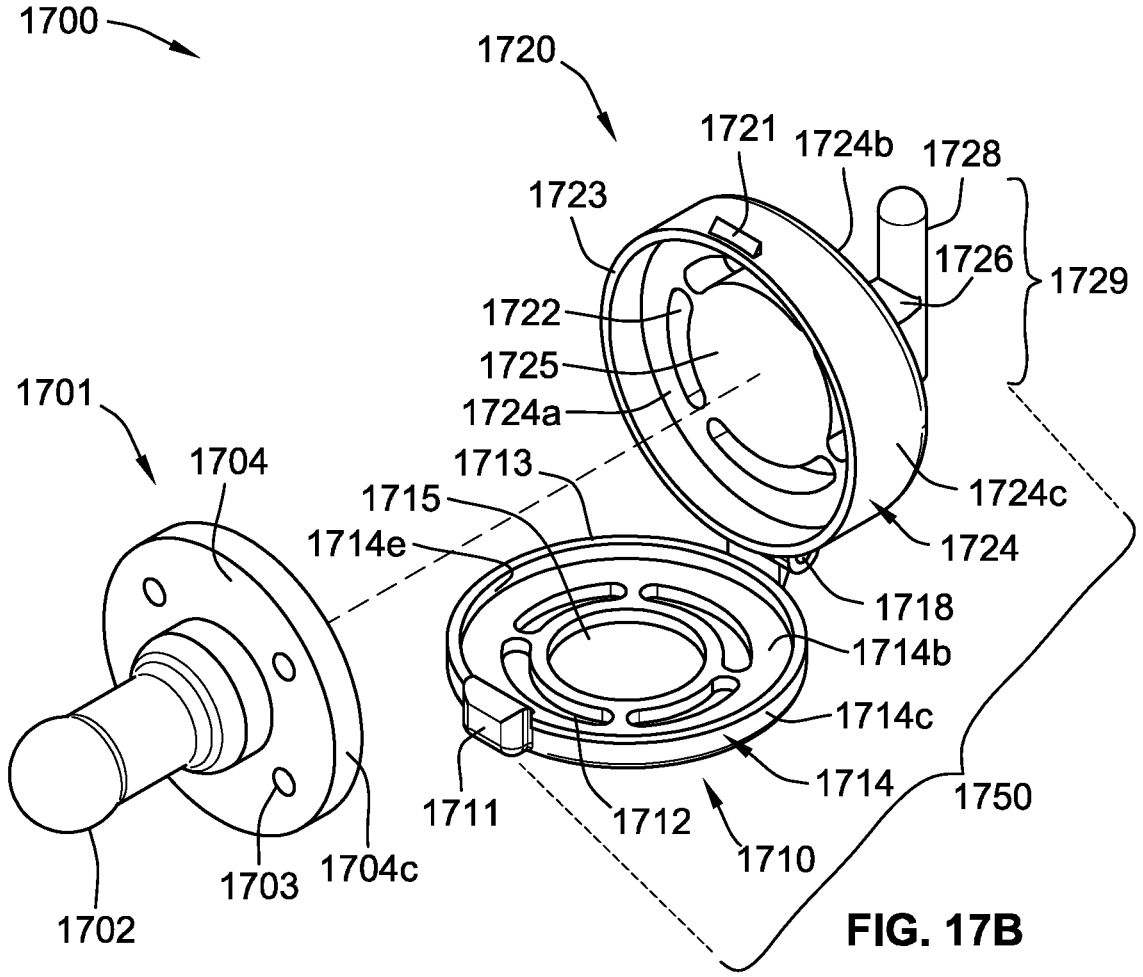

FIGS. 17A-17B show front perspective and exploded front perspective views respectively, of a second embodiment of a pacifier device 1700 having a sucker 1701 and an adapter 1750. The adapter 1750 includes an attachment portion 1729 and a compartment 1720 for accommodating the sucker 1701. The attachment portion 1729 is coupled to the compartment 1720. The pacifier device 1700 can be used independently or coupled to a body (e.g., body 805, body 1205) to form a pacifier system, such as those described above. Additionally, the compartment 1720 can be used to accommodate soft toys and other playful things, and then coupled to the body using the attachment portion 1729.

The sucker 1701 has a nipple portion 1702 and a base portion 1704. The base portion 1704 includes a front surface 1704*a*, a rear surface 1704*b*, and an outer surface 1704*c* between the front surface 1704*a* and the rear surface 1704*b*. The base portion 1704 includes breathing apertures 1703 through and between the front surface 1704*a* and the rear surface 1704*b*. The breathing apertures 1703 are substantially similar to the breathing apertures 703 described above.

The nipple portion 1702 is coupled to the base portion 1704 and extends in a first direction from the front surface 1704*a* of the base portion 1704. The nipple portion 1702 and the base portion 1704 are substantially similar to those of the first sucker 106 described with respect to FIG. 1-5 above, but does not include an attachment portion.

The compartment 1720 is generally cylindrical in shape, though other shapes such as a cuboid, a sphere, etc. are also contemplated. The compartment 1720 is designed to accommodate the sucker 1701 in a protruding orientation. The compartment 1720 includes a central cavity 1725 surrounded by a wall 1724 with a rim 1723. The wall 1724 has an outer surface 1724*c* and an inner surface 1724*e*. The outer surface 1724*c* has a notch 1721 adjacent to the rim 1643 for connecting with a clip to cover the compartment 1720. The central cavity 1725 has a bottom surface 1724*a* that contacts the rear surface 1704*b* of base portion 1704 of the sucker 1701, when the sucker 1701 is placed in the compartment 1720. The bottom surface 1724*a* includes one or more vents 1722 to align with the breathing apertures 1703 on the rear surface 1704*b* of base portion 1704 of the sucker 1701. The compartment 1720 further includes a rear surface 1724*b*. In some implementations, the rear surface 1724*b* may have a chamfered rear edge 1724*d*.

The adapter 1750 includes a lid 1710 for sealably closing the compartment 1720. The lid 1710 is coupled to the compartment 1720 via a hinge 1718. The hinge 1718 is positioned diametrically opposite to the notch 1721. The lid 1710 includes a central opening 1715 through which the nipple portion 1702 can be accommodated, when the sucker 1701 is placed in the compartment 1720. The central opening 1715 is surrounded by a wall 1714 with a rim 1713. The lid 1710 has a front surface 1714*a*, a rear surface 1714*b*, and an outer surface 1714*c*. In some implementations, the front surface 1714*a* may have a chamfered front edge 1714*f* The lid 1710 also includes one or more vents 1712 that align with the breathing apertures 1703 of the sucker 1701, when the lid 1710 is placed over the compartment 1720 and the nipple portion 1702 is in the protruding orientation. Finally, in the implementations shown in FIGS. 17A-17B, the lid 1710 includes a clip 1711 configured to mate with the notch 1721 to seal the compartment 1720. In other implementations, different snapping mechanisms may be used to seal the lid 1710 over the compartment 1720.

In some implementations, the attachment portion 1729 is coupled to the rear surface 1724*b* of the compartment 1720 and extends in a direction opposite to the direction along which the nipple portion 1702 of the sucker 1701 protrudes from the compartment 1720. In other implementations, the attachment portion 1729 may extend from the compartment 1720 at an angle with respect to the direction along which the nipple portion 1702 protrudes, such as from a side of the compartment 1720. In some implementations, the attachment portion 1729 is detachable from the compartment 1720. In some implementations such as shown in FIGS. 17A-17B, the attachment portion 1729 generally has a T-shape formed by a first linking member 1726 attached to the rear surface 1724*b* of the compartment 1720 and a second linking member 1728 perpendicular to the first linking member 1726. In other implementations, the attachment portion 1729 may have a C-shape, Z-shape, L-shape, S-shape, X-shape, V-shape, Y-shape, and the like. It is contemplated that the pacifier device 1700 may be secured to a body or a hub (e.g., body 805, body 1105) to form a pacifier system.

Figure 18A:
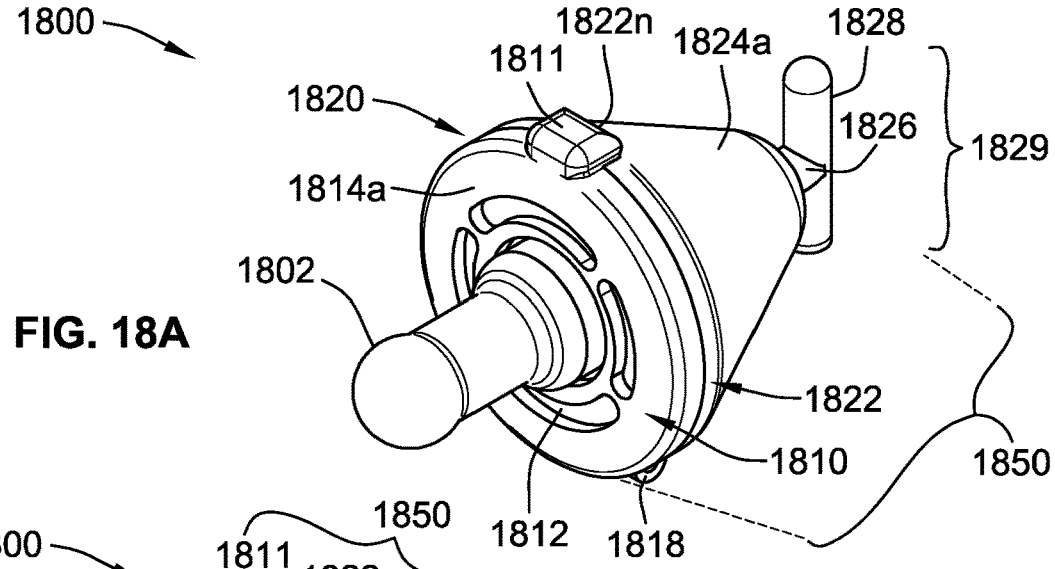
FIGS. 18A-18C show front perspective, cross-sectional, and exploded front perspective views respectively of a third embodiment of a pacifier device having an adapter with a compartment where a sucker is in a protruding configuration and an attachment portion is coupled to the compartment, according to some implementations of the present disclosure.
Figure 18B:
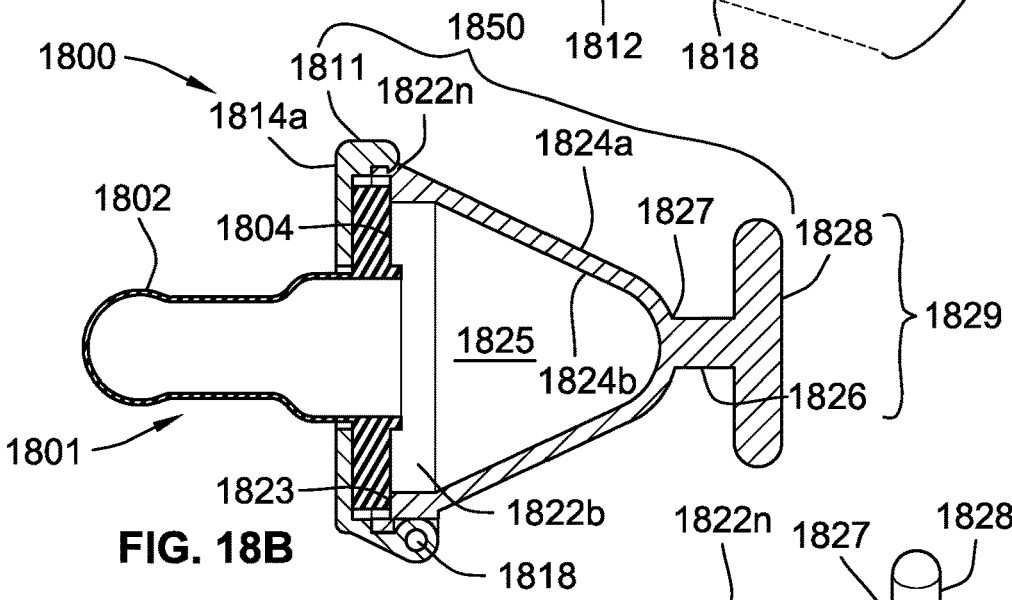
Figure 18C:
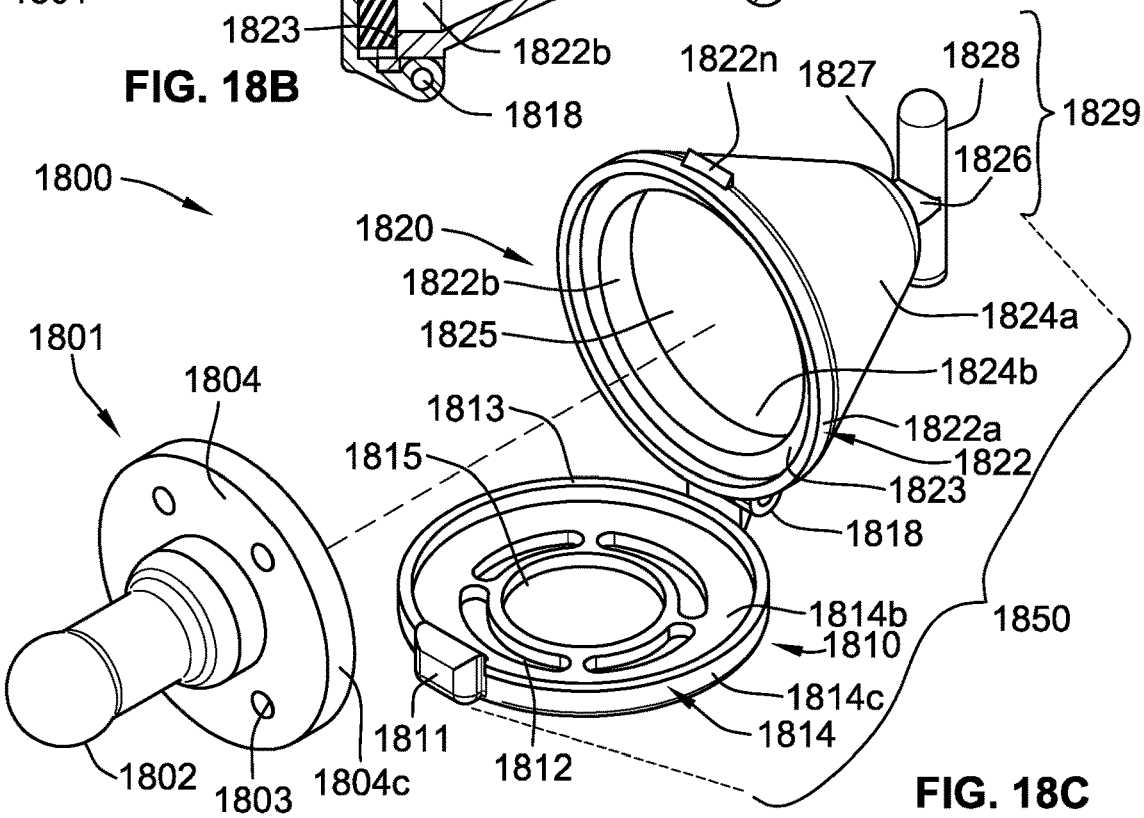

FIGS. 18A-18C show front perspective, cross-sectional, and exploded front perspective views respectively of a third embodiment of a pacifier device 1800 having a sucker 1801 and an adapter 1850. The adapter 1850 includes an attachment portion 1829 and a compartment 1820 for accommodating the sucker 1801 in a protruding configuration. The attachment portion 1829 is coupled to the compartment 1820. The pacifier device 1800 can be used independently or coupled to a body (e.g., body 805, body 1205) to form a pacifier system, such as those described above. Additionally, the compartment 1820 can be used to accommodate soft toys and other playful things, and then coupled to the body using the attachment portion 1829.

The sucker 1801 has a nipple portion 1802 and a base portion 1804. The base portion 1804 includes a front surface 1804*a*, a rear surface 1804*b*, and an outer surface 1804*c* between the front surface 1804*a* and the rear surface 1804*b*. The base portion 1804 includes breathing apertures 1803 through and between the front surface 1804*a* and the rear surface 1804*b*. The breathing apertures 1803 are substantially similar to the breathing apertures 703 described above.

The nipple portion 1802 is coupled to the base portion 1804 and extends in a first direction from the front surface 1804*a* of the base portion 1804. The nipple portion 1802 and the base portion 1804 are substantially similar to those of the first sucker 106 described with respect to FIG. 1-5 above, but does not include an attachment portion.

The compartment 1820 is generally conical in shape to accommodate the sucker 1601 in both a protruding orientation and a storing orientation. However, the compartment 1820 may have other shapes such as a cylinder, a cuboid, a pyramid, etc. that are configured to accommodate the sucker 1601 in both a protruding orientation and a storing orientation. The compartment 1820 includes a central cavity 1825 surrounded by a wall 1824 with a rim 1823. The wall 1824 has an outer surface 1824*a* and an inner surface 1824*b*. A base wall 1822 separates the rim 1823 from the wall 1824. The base wall 1822 has an outer surface 1822*a*, an inner surface 1822*b*, and a notch 1822*n* on the outer surface 1822*a*. The notch 1822*n* is configured to connect with a clip to cover the compartment 1820.

The adapter 1850 includes a lid 1810 for sealably closing the compartment 1820. The lid 1810 is coupled to the compartment 1820 via a hinge 1818. The hinge 1818 is position diametrically opposite to the notch 1822*n*. The lid 1810 includes a central opening 1815 through which the nipple portion 1802 can be accommodated, when the sucker 1801 is placed in the compartment 1820. The central opening 1815 is surrounded by a wall 1814 with a rim 1813. The lid 1810 has a front surface 1814*a*, a rear surface 1814*b*, and an outer surface 1814*c*. In some implementations, the front surface 1814*a* may have a chamfered front edge 1814*f* The lid 1810 also includes one or more vents 1812 that align with the breathing apertures 1803 of the sucker 1801, when the lid 1810 is placed over the compartment 1820 and the nipple portion 1802 is in the protruding orientation. Finally, in the implementations shown in FIGS. 18A-18B, the lid 1810 includes a clip 1811 configured to mate with the notch 1822*n* to seal the compartment 1820. In other implementations, different snapping mechanisms may be used to seal the lid 1810 over the compartment 1820. In the protruding configuration shown in FIGS. 18A-18C, the base wall 1822 is configured to accommodate the base portion 1804 of the sucker 1801 such that the nipple portion 1802 protrudes through the central opening 1815 of the lid 1810.

The compartment 1820 has a vertex 1827 to which the attachment portion 1829 is attached. In some implementations, the attachment portion 1829 is coupled at the vertex 1827 of the compartment 1820 and extends in a direction opposite to the direction along which the nipple portion 1802 of the sucker 1801 protrudes from the compartment 1820. In other implementations, the attachment portion 1829 may extend from the compartment 1820 at an angle with respect to the direction along which the nipple portion 1802 protrudes, such as from a side of the compartment 1820. In some implementations, the attachment portion 1829 is detachable from the compartment 1820. In some implementations such as shown in FIGS. 18A-18C, the attachment portion 1829 generally has a T-shape formed by a first linking member 1826 attached to the vertex 1827 and a second linking member 1828 perpendicular to the first linking member 1826. In other implementations, the attachment portion 1829 may have a C-shape, Z-shape, L-shape, S-shape, X-shape, V-shape, Y-shape, and the like.

Figure 18D:
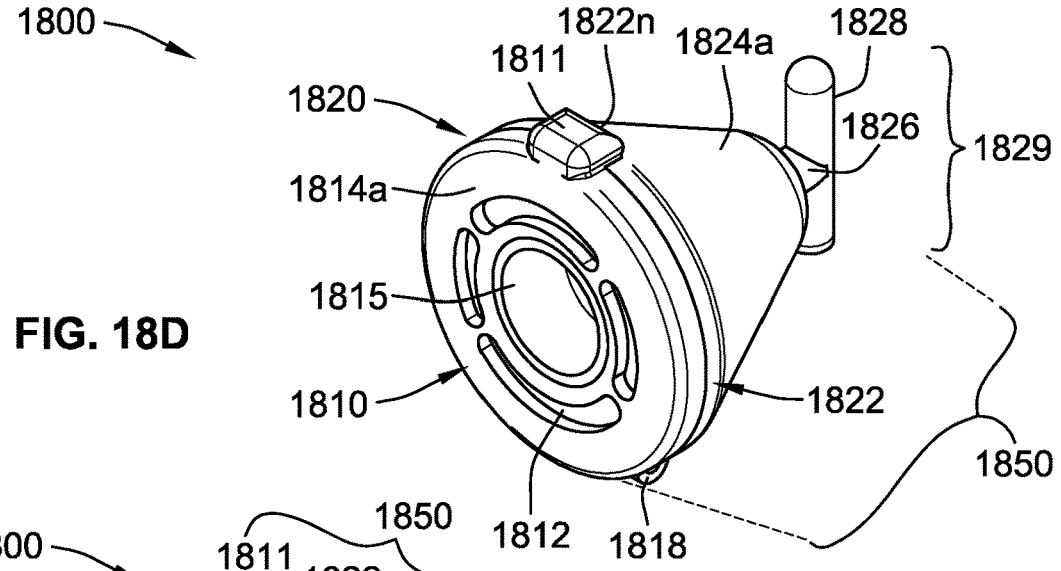
FIGS. 18D-18F show front perspective, cross-sectional, and exploded front perspective views respectively of the third embodiment of the pacifier device where the sucker is in a storing configuration, according to some implementations of the present disclosure.
Figure 18E:
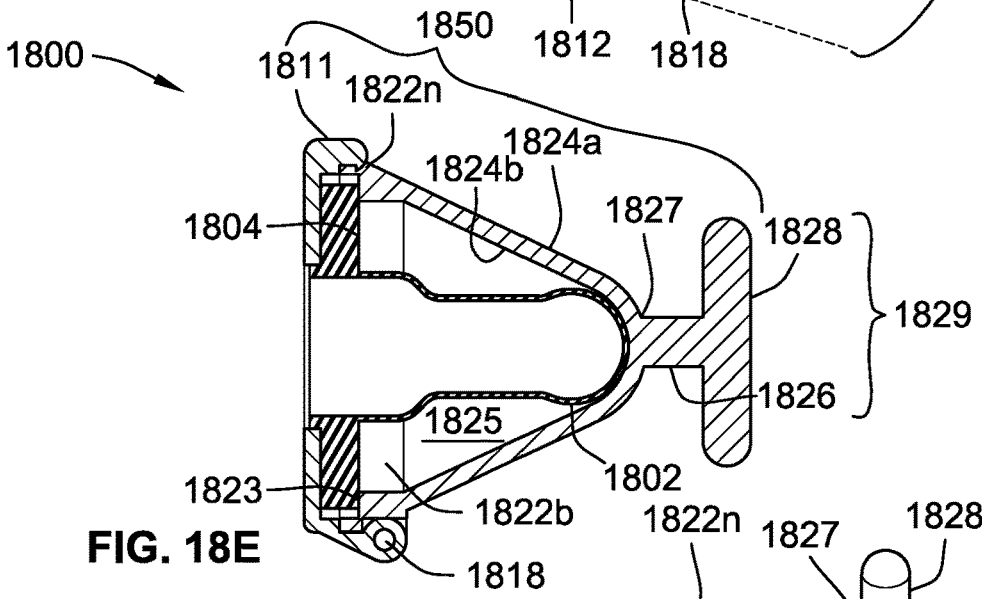
Figure 18F:
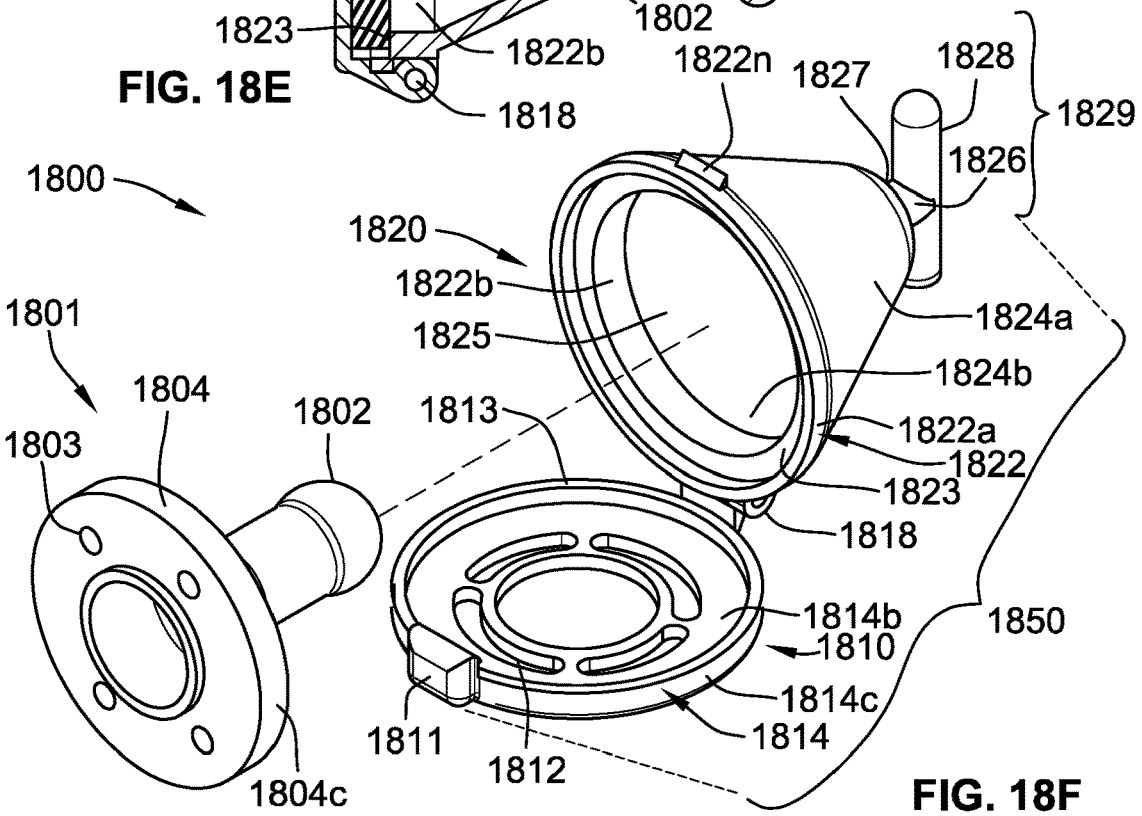

FIGS. 18D-18F show front perspective, cross-sectional, and exploded front perspective views respectively of the pacifier device 1800, where the sucker 1801 is in a storing configuration. In the storing configuration shown in FIGS. 18D-18F, the base wall 1822 is configured to accommodate the base portion 1804 of the sucker 1801 and the nipple portion 1802 fits snugly against the inner surface 1824*b* of the wall 1824 within the central cavity 1825 adjacent to the vertex 1827. The lid 1810 sealably covers the compartment 1820 in this storing configuration. This secures the sucker 1801, when not in use, thereby preventing exposure to dirt, dust, and other harmful effects. It is contemplated that the pacifier device 1800 may be secured to a body or a hub (e.g., body 805, body 1105) to form a pacifier system.

Figures 19A, 19B:
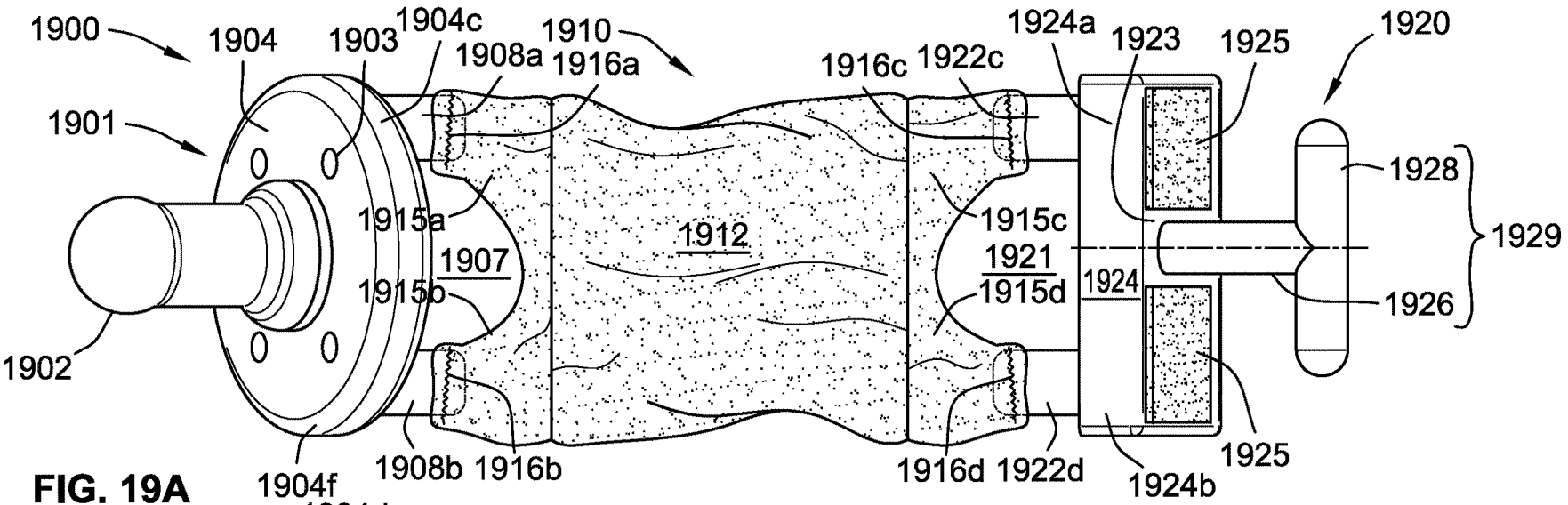
FIGS. 19A-19B show front perspective and rear perspective views respectively of a fourth embodiment of a pacifier device having an object of plush material and two pairs of tabs on opposite ends of the object connecting to a sucker and a rotatable attachment portion, according to some implementations of the present disclosure.

FIGS. 19A-19B show front perspective and rear perspective views respectively of a fourth embodiment of a pacifier device 1900. The pacifier device 1900 has an object 1910 of a plush material and a sucker 1901, which is substantially similar to the first sucker 106 described above. Different kinds and properties of a plush material are discussed above. In some implementations, the object 1910 may have a single layer of the plush material. In some implementations, the object 1910 may include additional weights, as discussed above, which aid in maintaining a position of the sucker 1901 when in use. The object 1910 has a front surface 1912 and a back surface 1914. The object 1910 is coupled at one end to the sucker 1901 and at the opposite end to a connector portion 1920. The object 1910 has a first pair of bifurcated open branches 1915*a*, 1915*b* coupled to the sucker 1901. The object 1910 has a second pair of bifurcated open branches 1915*c*, 1915*d* coupled to the connector portion 1920.

The first pair of bifurcated open branches 1915*a*, 1915*b* form a first notch 1907 around a first tab 1908*a* and a second tab 1908*b* that are coupled to the sucker 1901. The first tab 1908*a* is disposed adjacent to a first side portion (shown in FIGS. 4A-4B for the first sucker 106) of the base portion 1904 of the sucker 1901 and coupled to the open branch 1915*a*. The second tab 1908*b* is disposed adjacent to an opposing second side portion (shown in FIGS. 4A-4B for the first sucker 106) of the base portion 1904 of the sucker 1901 and coupled to the open branch 1915*b*. In some implementations, the first tab 1908*a* and the second tab 1908*b* are coupled to the open branches 1915*a* and 1915*b* using stitches 1916*a* and 1916*b* respectively.

The second pair of bifurcated open branches 1915*c*, 1915*d* form a second notch 1921 around a third tab 1922*c* and a fourth tab 1922*d* that are coupled to the attachment portion 1920. The third tab 1922*c* is disposed through a first orifice 1927*a* adjacent to a first side portion 1924*a* of the attachment base portion 1924 and coupled to the open branch 1915*c*. The fourth tab 1922*d* is disposed through a second orifice 1927*b* adjacent to an opposing second side portion 1924*b* of the attachment base portion 1924 and coupled to the open branch 1915*d*. In some implementations, the third tab 1922*c* and the fourth tab 1922*d* are coupled to the open branches 1915*c* and 1915*d* using stitches 1916*c* and 1916*d* respectively.

The sucker 1901 includes a nipple portion 1902 and a base portion 1904. The base portion 1904 includes a front surface 1904*a*, a rear surface 1904*b*, and an outer surface 1904*c* between the front surface 1904*a* and the rear surface 1904*b*. In some implementations, the base portion 1904 has a chamfered front edge 1904*f* and a chamfered rear edge 1904*d*. The base portion 1904 includes breathing apertures 1903 through and between the front surface 1904*a* and the rear surface 1904*b*. The breathing apertures 1903 are substantially similar to the breathing apertures 703 discussed above. The rear surface 1904*b* includes a finger cavity 1905 for holding the sucker 1901 through the first notch 1907. The finger cavity 1905 is centrally positioned on the rear surface 1904*b* and is supported by a rim wall 1906.

The nipple portion 1902 is coupled to the base portion 1904 and extends in a first direction from the front surface 1904*a* of the base portion 1904. The nipple portion 1902 and the base portion 1904 are substantially similar to those of the first sucker 106 described with respect to FIG. 1-5 above, except that the sucker 1901 has the two tabs 1908*a* and 1908*b* attached to the rear surface 1904*b*.

The connector portion 1920 includes a connector base 1924 and a rear portion 1923. In some implementations, the connector base 1924 is coupled to an attachment portion 1929. The attachment portion 1929 generally has a T-shape formed by a first linking member 1926 attached to the rear portion 1923 of the connector base 1924 and a second linking member 1928 perpendicular to the first linking member 1926. In other implementations, the connector portion 1920 may have an attachment portion 1929 having a C-shape, Z-shape, L-shape, S-shape, X-shape, V-shape, Y-shape, and the like. In some implementations, the rear portion 1923 includes a coupling mechanism having one or more strips of hook-and-loop fasteners (e.g., Velcro®) or magnetic pieces which enable the attachment portion 1929 to attach to a body or hub. In other implementations, a different coupling mechanism may be disposed on or adjacent to the rear portion 1923 and configured to couple the pacifier device 1900 to a suitable location for use by a baby. The attachment portion 1929 operates substantially similar to the attachment portions 709 and 1109 described above and can be inserted into a slot for using the pacific device only when in a first orientation, but not when in a second orientation. It is contemplated that the pacifier device 1900 may be secured to a body or a hub (e.g., body 805, body 1105) to form a pacifier system.

Advantageously, the implementations of the pacifier device described herein offer convenient, safe, and hygienic use of the pacifier devices by a baby. The pacifier devices, particularly those in the adapter form can be easily coupled to a slot within a body for convenient use by the baby. Various soft toys and playful things can be stored within the compartment in the adapter form and can then be attached to a slot within a body. The attachment portion of the pacifier devices has a complicated mechanism for coupling and decoupling to a body through use of a rotational motion of linking members and a coupling mechanism between the attachment portion and an outer surface of the body. This prevents the pacifier devices from being easily detached by a baby. Finally, the pacifier devices also include in-built structures that enable safe and hygienic storage of the sucker.

One or more elements or aspects or steps, or any portion(s) thereof, from one or more of any of claims 1-84 below can be combined with one or more elements or aspects or steps, or any portion(s) thereof, from one or more of any of the other claims 1-84 or combinations thereof, to form one or more additional implementations and/or claims of the present disclosure.

While the present disclosure has been described with reference to one or more particular embodiments or implementations, those skilled in the art will recognize that many changes may be made thereto without departing from the spirit and scope of the present disclosure. Each of these implementations and obvious variations thereof is contemplated as falling within the spirit and scope of the present disclosure. It is also contemplated that additional implementations according to aspects of the present disclosure may combine any number of features from any of the implementations described herein.

What is claimed is:

1. A pacifier system comprising:

a hub having an outer surface with a slot therein that extends into the hub; and a pacifier device including:

a base portion;

a nipple portion coupled to and protruding from the base portion in a first direction; and an attachment portion coupled to and protruding from the base portion in a second direction that is generally opposite to the first direction, the attachment portion being configured to rotate with the pacifier device to aid in connecting the pacifier device to a hub, the attachment portion including:

an object of plush material, the object having a first pair of bifurcated open branches forming a first notch at a first end of the object and a second pair of bifurcated open branches forming a second notch at a second opposing end of the object;

a first tab disposed adjacent to a first side portion of the base portion and coupled to a first of the first pair of bifurcated open branches;

a second tab disposed adjacent to an opposing second side portion of the base portion and coupled to a second of the first pair of bifurcated open branches;

a third tab disposed adjacent to a first side portion of the attachment portion and coupled to a first of the second pair of bifurcated open branches; and a fourth tab disposed adjacent to a second side portion of the attachment portion and coupled to a second of the second pair of bifurcated open branches;

a second pacifier device having a second nipple portion and a second attachment portion; and a third pacifier device having a third nipple portion and a third attachment portion;

wherein the hub further includes a second slot along the outer surface and a third slot along the outer surface, and wherein the second attachment portion is configured to be inserted into the second slot to aid in connecting the second pacifier device with the hub and the third attachment portion is configured to be inserted into the third slot to aid in connecting the third pacifier device with the hub.

2. The pacifier system of claim 1, wherein the slot opens into a first chamber configured to receive the attachment portion and a second chamber interior of the first chamber.

3. The pacifier system of claim 2, wherein the first chamber is to configured to (i) receive, from the slot, at least a portion of the attachment portion, responsive to the attachment portion being in a first orientation and not in a second orientation and (ii) permit the attachment portion to rotate within the first chamber from the first orientation to the second orientation, the second orientation being rotated about 90 degrees relative to the first orientation.

4. The pacifier system of claim 3, wherein the second chamber is configured to receive, from the first chamber, at least a portion of the attachment portion, responsive to the attachment portion being in the second orientation and not in the first orientation.

5. The pacifier system of claim 4, wherein the second chamber is configured to aid in preventing the attachment portion from rotating responsive to at least a portion of the attachment portion being in the second orientation.

6. The pacifier system of claim 1, wherein the second slot and the third slot are regularly spaced along the outer surface.

7. The pacifier system of claim 1, wherein the object of plush material is between about 1.5 inches and about 6 inches in length.

8. The pacifier system of claim 1, wherein the attachment portion is coupled to the base portion using one or more stitches.

9. The pacifier system of claim 1, wherein the nipple portion is coupled to the base portion via one or more fasteners.

10. The pacifier system of claim 9, wherein the one or more fasteners include one or more of hook and loop fasteners, snaps, clips, toggles, and zippers.

11. The pacifier system of claim 1, wherein the object of plush material comprises one or more sheets of material sewn together and stuffed with a plush material.

12. The pacifier system of claim 1, further comprising:

one or more weights positioned with the object of plush material, the one or more weights aiding in maintaining a position of the pacifier system when in use on a chest of a baby.

13. The pacifier system of claim 12, wherein the one or more weights include one or more of beads or beans made of plastic, rubber, metal, silicone, and relatively dense plush material.

14. The pacifier system of claim 1, wherein one or both of the first pair of bifurcated open branches and the second pair of bifurcated open branches define a finger cavity configured to receive at least a portion of a finger therein.

15. The pacifier system of claim 1, wherein the hub is generally cylindrical in shape.

16. The pacifier system of claim 1, wherein the hub includes a central cavity configured to sealably store a bag coupled therein.

17. The pacifier system of claim 16, wherein the bag, when decompressed, is configured to envelope the pacifier system.

18. The pacifier system of claim 17, where the bag is coupled to a drawstring configured to tighten the bag around the pacifier system.

19. The pacifier system of claim 1, wherein the attachment portion generally has one of (i) a T-shape, (ii) a C-shape, (iii) a Z-shape, (iv) an L-shape, (v) an S-shape, (vi) an X-shape, (vii) a V-shape, and (viii) a Y-shape.

* * * * *